US010480251B2

(12) United States Patent
Radford et al.

(10) Patent No.: US 10,480,251 B2
(45) **Date of Patent: *Nov. 19, 2019**

(54) EXPANDABLE DOWNHOLE TOOL ASSEMBLIES, BOTTOM-HOLE ASSEMBLIES, AND RELATED METHODS

(71) Applicant: Baker Hughes, a GE company, LLC, Houston, TX (US)

(72) Inventors: Steven R. Radford, South Jordan, UT (US); Marcus Oesterberg, Kingwood, TX (US); Khoi Q. Trinh, Pearland, TX (US); Timothy Miller, Spring, TX (US); Shyam Anandampillai, Houston, TX (US); Chad T. Jurica, Conroe, TX (US); Wolfgang E. Herberg, Niedersachsen (DE); Carsten Haubold, Celle (DE); Christopher Jakubeit, Langenhagen (DE); Michael Wiegmann, Gross Oesingen (DE); Jens Behnsen, Burgdorf (DE); Hans-Juergen Faber, Neustadt (DE)

(73) Assignee: Baker Hughes, a GE company, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/049,166

(22) Filed: Jul. 30, 2018

(65) Prior Publication Data

US 2018/0334857 A1 Nov. 22, 2018

Related U.S. Application Data

(63) Continuation of application No. 15/154,672, filed on May 13, 2016, now Pat. No. 10,036,206, which is a (Continued)

(51) Int. Cl.
*E21B 10/32* (2006.01)
*E21B 47/12* (2012.01)

(Continued)

(52) U.S. Cl.
CPC ..... *E21B 10/32* (2013.01); *E21B 10/322* (2013.01); *E21B 44/00* (2013.01); *E21B 47/12* (2013.01); *E21B 47/122* (2013.01); *E21B 10/26* (2013.01)

(58) Field of Classification Search
CPC ..... E21B 47/12; E21B 10/322; E21B 17/042
See application file for complete search history.

(56) References Cited

U.S. PATENT DOCUMENTS 1,678,075 A 7/1928 Phipps
2,069,482 A 2/1937 Seay (Continued)

FOREIGN PATENT DOCUMENTS

AU 2973397 A 1/1998
AU 710317 B2 9/1999

(Continued)

OTHER PUBLICATIONS

International Preliminary Report on Patentability for International Application No. PCT/US2014/020270 dated Sep. 8, 2015, 7 pages.

(Continued)

*Primary Examiner* — Jennifer H Gay
(74) *Attorney, Agent, or Firm* — TraskBritt

(57) ABSTRACT

Expandable reamer assemblies include an expandable reamer module and an activation module. An outer tubular body of the activation module is rigidly coupled to a tubular body of the expandable reamer module, and an activation member of the activation module is coupled to a sleeve of the expandable reamer module, the sleeve coupled to at least one blade and configured to move the at least one blade into (Continued)

an extended position. The sleeve moves axially responsive to axial movement of the activation member. Bottom-hole assemblies include an expandable reamer module and an activation module. The activation module is coupled to the expandable reamer module and configured to provide a motive force to the sleeve to move the sleeve opposite a direction of flow of drilling fluid. Methods of using expandable reamer modules include pairing two substantially identical expandable reamer modules and two respective different activation modules.

20 Claims, 11 Drawing Sheets

Related U.S. Application Data continuation of application No. 13/784,284, filed on Mar. 4, 2013, now Pat. No. 9,341,027.

(51) Int. Cl.
*E21B 44/00* (2006.01)
*E21B 10/26* (2006.01)

(56) References Cited

U.S. PATENT DOCUMENTS 2,136,518 A 11/1938 Nixon
2,177,721 A 10/1939 Johnson et al.
2,344,598 A 3/1944 Church
2,532,418 A 12/1950 Page
2,638,988 A 5/1953 Williams
2,834,578 A 9/1955 Carr
2,754,089 A 7/1956 Kammerer, Jr.
2,758,819 A 8/1956 Kammerer, Jr.
2,882,019 A 10/1956 Carr et al.
2,874,784 A 2/1959 Baker, Jr. et al.
3,083,765 A 4/1963 Kammerer
3,105,562 A 10/1963 Stone et al.
3,123,162 A 3/1964 Rowley
3,126,065 A 3/1964 Chadderdon
3,171,502 A 3/1965 Kammerer
3,208,540 A * 9/1965 Park ..... E21B 10/322 175/269
3,211,232 A 10/1965 Grimmer
3,224,507 A 12/1965 Cordary, Jr.
3,283,834 A 11/1966 Kammerer
3,289,760 A 12/1966 Kammerer
3,351,137 A 11/1967 Schulz et al.
3,425,500 A 2/1969 Fuchs
3,433,313 A 3/1969 Brown
3,472,533 A 10/1969 Turner
3,556,233 A 1/1971 Gilreath et al.
4,055,226 A 10/1977 Weber
4,231,437 A 11/1980 Swersky et al.
4,366,971 A 1/1983 Lula
4,403,659 A 9/1983 Upchurch
4,458,761 A 7/1984 Van Vreeswyk
4,545,441 A 10/1985 Williamson
4,589,504 A 5/1986 Simpson
4,660,657 A 4/1987 Furse et al.
4,690,229 A 9/1987 Raney
4,693,328 A 9/1987 Furse et al.
4,698,794 A 10/1987 Kruger et al.
4,756,372 A 7/1988 Airey
4,842,083 A 6/1989 Raney
4,848,490 A 7/1989 Anderson
4,854,403 A 8/1989 Ostertag et al.
4,856,828 A 8/1989 Kessler et al.
4,884,477 A 12/1989 Smith et al.
4,889,197 A 12/1989 Boe
4,893,678 A 1/1990 Stokley et al.
4,944,350 A 7/1990 Airey
5,065,825 A 11/1991 Bardin et al.
5,074,356 A 12/1991 Neff
5,129,689 A 7/1992 Newski et al.
5,139,098 A 8/1992 Blake
5,211,241 A 5/1993 Mashaw et al.
5,224,558 A 7/1993 Lee
5,265,684 A 11/1993 Rosenhauch
5,293,945 A 3/1994 Rosenhauch et al.
5,305,833 A 4/1994 Collins
5,318,131 A 6/1994 Baker
5,318,137 A 6/1994 Johnson et al.
5,318,138 A 6/1994 Dewey et al.
5,332,048 A 7/1994 Underwood et al.
5,343,963 A 9/1994 Bouldin et al.
5,361,859 A 11/1994 Tibbitts
5,368,114 A 11/1994 Tandberg et al.
5,375,662 A 12/1994 Echols, III et al.
5,402,856 A 4/1995 Warren
5,406,983 A 4/1995 Chambers
5,415,243 A 5/1995 Lyon et al.
5,425,423 A 6/1995 Dobson et al.
5,437,308 A 8/1995 Morin et al.
5,443,129 A 8/1995 Bailey et al.
5,553,678 A 9/1996 Barr et al.
5,560,440 A 10/1996 Tibbitts
5,740,864 A 4/1998 de Hoedt et al.
5,765,653 A 6/1998 Doster et al.
5,788,000 A 8/1998 Maury et al.
5,823,254 A 10/1998 Dobson et al.
5,826,652 A 10/1998 Tapp
5,862,870 A 1/1999 Hutchinson et al.
5,887,655 A 3/1999 Haugen et al.
6,039,131 A 3/2000 Beaton
6,059,051 A 5/2000 Jewkes et al.
6,070,677 A 6/2000 Johnston, Jr.
6,109,354 A 8/2000 Riggenberg et al.
6,116,336 A 9/2000 Adkins et al.
6,131,675 A 10/2000 Anderson
6,173,795 B1 1/2001 McGarian et al.
6,189,631 B1 2/2001 Sheshtawy
6,213,226 B1 4/2001 Eppink et al.
6,227,312 B1 5/2001 Eppink et al.
6,289,999 B1 9/2001 Dewey et al.
6,325,151 B1 12/2001 Vincent et al.
6,360,831 B1 3/2002 Akesson et al.
6,378,632 B1 4/2002 Dewey et al.
6,488,104 B1 12/2002 Eppink et al.
6,494,272 B1 12/2002 Eppink et al.
6,615,933 B1 9/2003 Eddison
6,668,936 B2 12/2003 Williamson, Jr. et al.
6,668,949 B1 12/2003 Rives
6,681,860 B1 1/2004 Yokley et al.
6,702,020 B2 3/2004 Zachman et al.
6,708,785 B1 3/2004 Russell et al.
6,732,817 B2 5/2004 Dewey et al.
7,036,611 B2 5/2006 Radford et al.
7,048,078 B2 5/2006 Dewey et al.
7,252,163 B2 8/2007 Ollerenshaw
7,314,099 B2 1/2008 Dewey et al.
7,513,318 B2 4/2009 Underwood et al.
7,681,666 B2 3/2010 Radford et al.
7,757,787 B2 7/2010 Mackay et al.
7,823,663 B2 11/2010 Eddison
7,900,717 B2 3/2011 Radford et al.
8,020,635 B2 9/2011 Radford
8,074,747 B2 12/2011 Radford et al.
8,118,101 B2 2/2012 Nelson et al.
8,196,679 B2 6/2012 Radford
8,230,951 B2 7/2012 Radford et al.
8,297,381 B2 10/2012 Radford et al.
8,485,282 B2 7/2013 Gentry
8,540,035 B2 9/2013 Xu et al.
8,657,039 B2 2/2014 Radford et al.
8,844,635 B2 9/2014 Oxford
8,881,833 B2 11/2014 Radford et al.
8,936,110 B2 1/2015 Adam
8,986,028 B2 3/2015 Mueller et al.
9,027,650 B2 5/2015 Radford et al.
9,052,043 B2 6/2015 Mueller et al.
9,341,027 B2 5/2016 Radford et al.

(56) References Cited

U.S. PATENT DOCUMENTS

| | | | | |
|---|---|---|---|---|
| 9,587,454 | B1 | 3/2017 | Beard et al. | |
| 10,036,206 | B2 * | 7/2018 | Radford | E21B 10/322 |
| 2002/0070052 | A1 | 6/2002 | Armell et al. | |
| 2003/0026167 | A1 | 2/2003 | Hahn et al. | |
| 2003/0029644 | A1 | 2/2003 | Hoffmaster et al. | |
| 2004/0222022 | A1 | 11/2004 | Nevlud et al. | |
| 2005/0145417 | A1 | 7/2005 | Radford et al. | |
| 2006/0060384 | A1 | 3/2006 | Michael | |
| 2006/0144623 | A1 | 7/2006 | Ollerensaw | |
| 2006/0207797 | A1 | 9/2006 | Dewey et al. | |
| 2007/0089912 | A1 | 4/2007 | Eddison et al. | |
| 2008/0093080 | A1 | 4/2008 | Palmer et al. | |
| 2008/0128174 | A1 | 6/2008 | Radford et al. | |
| 2008/0128175 | A1 | 6/2008 | Radford et al. | |
| 2009/0032308 | A1 | 2/2009 | Eddison | |
| 2009/0057015 | A1 | 3/2009 | Treviranus et al. | |
| 2010/0006339 | A1 | 1/2010 | Desai | |
| 2010/0089583 | A1 | 4/2010 | Xu et al. | |
| 2010/0108394 | A1 | 5/2010 | Ollerenshaw | |
| 2010/0139981 | A1 | 6/2010 | Meister et al. | |
| 2010/0193248 | A1 | 8/2010 | Radford et al. | |
| 2010/0224414 | A1 | 9/2010 | Radford et al. | |
| 2011/0005836 | A1 | 1/2011 | Radford et al. | |
| 2011/0031023 | A1 | 2/2011 | Menezes et al. | |
| 2011/0073370 | A1 | 3/2011 | Gentry | |
| 2011/0073376 | A1 | 3/2011 | Radford et al. | |
| 2011/0127044 | A1 | 6/2011 | Radford et al. | |
| 2011/0198096 | A1 | 8/2011 | Mailand et al. | |
| 2011/0232915 | A1 | 9/2011 | Kellner et al. | |
| 2011/0278017 | A1 | 11/2011 | Themig et al. | |
| 2011/0284233 | A1 | 11/2011 | Wu et al. | |
| 2012/0018173 | A1 | 1/2012 | Herberg et al. | |
| 2012/0048571 | A1 | 3/2012 | Radford et al. | |
| 2012/0055714 | A1 | 3/2012 | Adam | |
| 2012/0080183 | A1 | 4/2012 | Radford et al. | |
| 2012/0080231 | A1 | 4/2012 | Radford et al. | |
| 2012/0084051 | A1 | 4/2012 | Hackner et al. | |
| 2012/0111574 | A1 | 5/2012 | Desranleau et al. | |
| 2012/0298422 | A1 | 11/2012 | Oxford | |
| 2013/0168099 | A1 | 7/2013 | Themig | |
| 2013/0206401 | A1 | 8/2013 | Bhoite et al. | |
| 2013/0292175 | A1 | 11/2013 | Radford et al. | |
| 2014/0110178 | A1 | 4/2014 | Savage et al. | |
| 2014/0144537 | A1 | 5/2014 | Peters et al. | |
| 2014/0148029 | A1 | 5/2014 | Mueller et al. | |
| 2014/0176334 | A1 | 6/2014 | Benedict et al. | |
| 2014/0246236 | A1 | 9/2014 | Radford et al. | |
| 2014/0246246 | A1 | 9/2014 | Radford | |
| 2014/0290930 | A1 | 10/2014 | Peters | |
| 2014/0332235 | A1 | 11/2014 | Mueller et al. | |
| 2014/0352941 | A1 | 12/2014 | Mueller et al. | |
| 2015/0027685 | A1 | 1/2015 | Peters et al. | |
| 2015/0041215 | A1 | 2/2015 | Schulz et al. | |
| 2015/0060041 | A1 | 3/2015 | Mueller et al. | |
| 2015/0070185 | A1 | 3/2015 | Schulz et al. | |
| 2015/0322725 | A1 | 11/2015 | Fuller et al. | |
| 2016/0251904 | A1 * | 9/2016 | Radford | E21B 10/322<br>175/40 |
| 2018/0334857 | A1 * | 11/2018 | Radford | E21B 10/322 |

FOREIGN PATENT DOCUMENTS

| | | | |
|---|---|---|---|
| EP | 246789 | A2 | 11/1987 |
| EP | 301890 | A2 | 2/1989 |
| EP | 594420 | A1 | 4/1994 |
| EP | 1036913 | A1 | 9/2000 |
| EP | 1044314 | A1 | 10/2000 |
| GB | 2328964 | A | 3/1999 |
| GB | 2344122 | A | 5/2000 |
| GB | 2344607 | A | 6/2000 |
| GB | 2385344 | A | 8/2003 |
| UY | 9928587 | A1 | 6/1999 |
| WO | 9747849 | | 12/1997 |
| WO | 9928588 | A | 6/1999 |
| WO | 31371 | A1 | 6/2000 |
| WO | 2004088091 | A1 | 10/2004 |
| WO | 2009132462 | A1 | 11/2009 |

OTHER PUBLICATIONS

International Written Opinion for International Application No. PCT/US2014/020270 dated Jun. 26, 2014, 6 pages.

* cited by examiner

EXPANDABLE DOWNHOLE TOOL ASSEMBLIES, BOTTOM-HOLE ASSEMBLIES, AND RELATED METHODS

CROSS-REFERENCE TO RELATED APPLICATIONS

This application is a continuation of U.S. patent application Ser. No. 15/154,672, filed May 13, 2016, now U.S. Pat. No. 10,036,206, issued Jul. 31, 2018 which is a continuation of U.S. patent application Ser. No. 13/784,284, filed Mar. 4, 2013, now U.S. Pat. No. 9,341,027, issued May 17, 2016, the disclosure of each of which is hereby incorporated herein in its entirety by this reference. The subject matter of this application is related to U.S. Provisional Patent Application Ser. No. 62/205,491, filed Aug. 14, 2015, and to U.S. patent application Ser. No. 14/858,063, filed Sep. 18, 2015, pending. The subject matter of this application is also related to U.S. patent application Ser. No. 13/784,307, filed Mar. 4, 2013, now U.S. Pat. No. 9,284,816 issued Mar. 15, 2016, and to U.S. patent application Ser. No. 15/042,623, filed Feb. 12, 2016, now U.S. Pat. No. 10,018,014, issued Jul. 10, 2018.

TECHNICAL FIELD

The present disclosure relates generally to expandable reamer assemblies for reaming a subterranean formation, as well as bottom-hole assemblies including expandable reamer assemblies, devices and systems for activating such expandable reamer assemblies, and related methods.

BACKGROUND

Wellbores are formed in subterranean formations for various purposes including, for example, the extraction of oil and gas from a subterranean formation and the extraction of geothermal heat from a subterranean formation. A wellbore may be formed in a subterranean formation using a drill bit, such as, for example, an earth-boring rotary drill bit. Different types of earth-boring rotary drill bits are known in the art, including, for example, fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). Earth-boring rotary drill bits are rotated and advanced into a subterranean formation. As the drill bit rotates, the cutters or abrasive structures thereof cut, crush, shear, and/or abrade away the formation material to form the wellbore. A diameter of the wellbore drilled by the drill bit may be defined by the cutting structures disposed at the largest outer diameter of the drill bit.

The drill bit is coupled, either directly or indirectly, to an end of what is referred to in the art as a "drill string," which comprises a series of elongated tubular segments connected end-to-end that extends into the wellbore from the surface of the formation. Often various tools and components (often referred to in the art as "subs"), including the drill bit, may be coupled together at the distal end of the drill string at the bottom of the wellbore being drilled. This assembly of tools and components is referred to in the art as a "bottom-hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through an annular space between the outer surface of the drill string and the exposed surface of the formation within the wellbore.

It is known in the art to use what is referred to in the art as a "reamer" (also referred to in the art as a "hole opening device" or a "hole opener") in conjunction with a drill bit as part of a BHA when drilling a wellbore in a subterranean formation. In such a configuration, the drill bit operates as a "pilot" bit to form a pilot bore in the subterranean formation. As the drill bit and BHA advance into the formation, the reamer follows the drill bit through the pilot bore and enlarges the diameter of, or "reams," the pilot bore.

Conventionally in drilling oil, gas, and geothermal wells, casing is installed and cemented to prevent the wellbore walls from caving into the subterranean borehole while providing requisite shoring for subsequent drilling operations to achieve greater depths. To increase the depth of a previously drilled borehole, Previously Presented casing is laid within and extended below the previous casing. While adding casing allows a borehole to reach greater depths, it has the disadvantage of narrowing the borehole. Narrowing the borehole restricts the diameter of any subsequent sections of the well because the drill bit and any further casing must pass through the existing casing. As reductions in the borehole diameter limit the production flow rate of oil and gas through the borehole, it is often desirable to enlarge a subterranean borehole to provide a larger borehole diameter beyond previously installed casing.

Expandable reamers may include reamer blades pivotably or hingedly affixed to a tubular body and actuated by way of a piston disposed therein as disclosed by U.S. Pat. No. 5,402,856 to Warren. In addition, U.S. Pat. No. 6,360,831 to Åkesson et al. discloses a borehole opener comprising a body equipped with at least two hole opening arms having cutting means that may be moved from a position of rest in the body to an active position by exposure to pressure of the drilling fluid flowing through the body. The blades in these reamers are initially retracted to permit the tool to run through the borehole on a drill string and, once the tool has passed beyond the end of the casing, the blades are extended so the bore diameter may be increased below the casing.

Expandable reamers include activation means for moving the reamer blades thereof between a deactivated position and an expanded, activated position. For example, prior known expandable reamers include a movable sleeve coupled to the reamer blades. As the movable sleeve moves axially within a body of the expandable reamer, the reamer blades move between the deactivated position and the activated position. The movement of the movable sleeve is accomplished by causing a pressure differential to push the movable sleeve in the desired axial direction. The pressure differential is provided by dropping a so-called "drop ball" into the drilling fluid. An orifice in the drilling fluid flow path smaller than the drop ball is provided in the expandable reamer, such that the drop ball cannot pass the orifice. When the drop ball reaches the orifice, pressure from the drilling fluid builds up above the drop ball, pushing the drop ball downward along with the structure in which the orifice is formed. Drilling fluid may then be directed to provide pressure against the movable sleeve, moving the movable sleeve upward and, consequently, moving the blades into the activated position. When drilling fluid pressure is released from against the movable sleeve, a spring biases the movable sleeve to move back into the deactivated position.

BRIEF SUMMARY

In some embodiments, the present disclosure includes expandable reamer assemblies for reaming a subterranean borehole. The expandable reamer assemblies include an expandable reamer module and an activation module. The expandable reamer module includes a tubular body, one or more blades, and a sleeve. The tubular body has a longitudinal axis and an inner bore. At least one of the blades is coupled to the tubular body and configured to move between a retracted position and an extended position. The sleeve is disposed within the inner bore of the tubular body and coupled to the at least one blade. The sleeve is configured to axially move relative to the tubular body to move the at least one blade into the extended position. The activation module includes an outer tubular body and an activation member at least partially disposed within an inner bore of the outer tubular body. The outer tubular body of the activation module is rigidly coupled to the tubular body of the expandable reamer module. A longitudinal end of the activation member is coupled to the sleeve to axially move the sleeve relative to the tubular body of the expandable reamer module responsive to axial movement of the activation member.

In some embodiments, the present disclosure includes bottom-hole assemblies including an expandable reamer module and an activation module. The expandable reamer module includes a first tubular body and the activation module includes a second tubular body coupled to first tubular body of the expandable reamer module. The expandable reamer module includes at least one reamer blade movably coupled to the first tubular body, and a sleeve axially movable within the first tubular body. The sleeve is coupled to the at least one reamer blade and configured to move the at least one reamer blade into an expanded position. The activation module includes an activation member coupled to the sleeve and configured to provide a motive force to the sleeve toward the activation module and opposite a direction of flow of drilling fluid through the bottom-hole assembly during use of the bottom-hole assembly. Such a motive force results in movement of the at least one reamer blade into the expanded position.

In other embodiments, the present disclosure includes methods of using expandable reamer modules. In accordance with such methods, a first expandable reamer module including a tubular body and an axially movable sleeve at least partially within the tubular body is provided. A first activation module is also provided, which includes a tubular body configured to be coupled to the tubular body of the first expandable reamer module. The first activation module also includes an axially movable activation member configured to be coupled to the sleeve of the first expandable reamer module such that axial movement of the activation member results in axial movement of the sleeve. The first activation module is configured to be activated with a first activation means. The first expandable reamer module and the first activation module are paired for use in a reaming process in which the first activation module activates the first expandable reamer module to ream a subterranean formation. A second expandable reamer module is provided that is substantially identical to the first expandable reamer module. A second activation module configured to be activated with a second, different activation means is also provided. The second expandable reamer module and the second activation module are paired for use in a reaming process in which the second activation module activates the second expandable reamer module to ream a subterranean formation.

BRIEF DESCRIPTION OF THE DRAWINGS

While the disclosure concludes with claims particularly pointing out and distinctly claiming that which is regarded as the invention, various features and advantages of the disclosure may be ascertained from the following detailed description, when read in conjunction with the accompanying drawings, in which:

DETAILED DESCRIPTION

The illustrations presented herein are, in some instances, not actual views of any particular reamer tool, bottom-hole assembly (BHA), expandable reamer assembly, or feature thereof, but are merely idealized representations that are employed to describe the present disclosure. Additionally, elements common between figures may retain the same numerical designation.

As used herein, any relational term, such as "first," "second," "over," "upper," "lower," "middle," "above," "below," etc., is used for clarity and convenience in understanding the disclosure and accompanying drawings, and does not connote or depend on any specific preference, orientation, or order, except where the context clearly indicates otherwise.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

Figure 1:
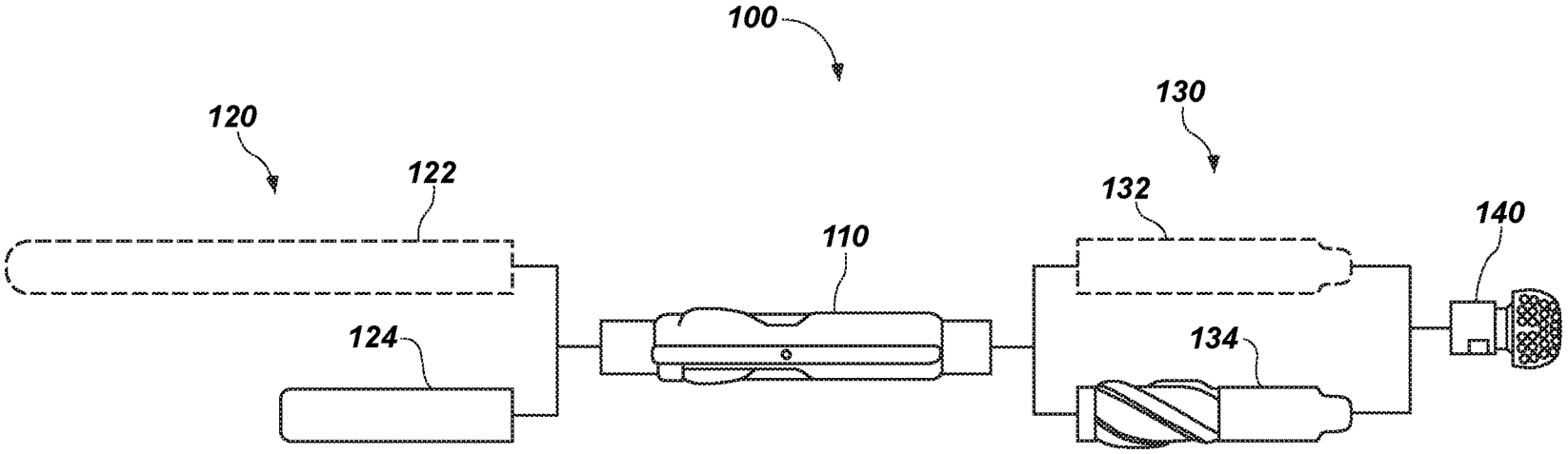
FIG. 1 is a schematic illustrating various ways in which modules can be combined to form a bottom-hole assembly (BHA), according to an embodiment of the present disclosure.

Referring to FIG. 1, a schematic 100 illustrates various ways in which modules can be combined to form a bottom-hole assembly (BHA) or an expandable reamer assembly for drilling into a subterranean formation in accordance with embodiments of the present disclosure. In general, the schematic 100 illustrates the concept that various modules may be interchangeable to form different BHAs or expandable reamer assemblies as desired, depending on various considerations, such as the characteristics of the formation to be drilled, cost constraints, maintenance capabilities, etc. Specific, practical applications of this concept are disclosed herein, as well as specific modules that are configured to be interchangeable and assemblies formed by combining such specific modules.

As shown in FIG. 1, an expandable reamer module 110 may be configured to be interchangeably coupled to one of various activation modules 120, such as an electronic and hydraulic activation module 122 or a mechanical activation module 124. As used herein, the phrase "electronic and hydraulic activation module" means and includes a module configured to activate a closed hydraulic system (i.e., a system including hydraulic fluid separated from drilling fluid) using an electrical signal. The electrical signal may be generated at a surface of the subterranean formation being reamed or may be generated by the electronic and hydraulic activation module 122 in response to a non-electrical signal. An example of an electronic and hydraulic activation module that may be used as the electronic and hydraulic activation module 122 is described in detail below with reference to FIGS. 11 through 14. The electronic and hydraulic activation module 122 may be configured to be activated by receiving a signal from the surface of the subterranean formation using a conductive wire, a radio-frequency identification (RFID) chip carried to the electronic and hydraulic activation module 122 by drilling fluid, a predetermined sequence of pressure pulses in the drilling fluid (also referred to as "drilling fluid force telemetry"), a predetermined (e.g., high) level of pressure in the drilling fluid, or a predetermined (e.g., high) drilling fluid flow rate. Once such a signal is received, the electronic and hydraulic activation module 122 may electrically activate a hydraulic portion of the electronic and hydraulic activation module 122. As used herein, the phrase "mechanical activation module" means and includes a module configured to be activated mechanically, without the use of an electrical signal. For example, the mechanical activation module 124 may be activated by a pressure differential caused by an obstruction in a drilling fluid flow path. The obstruction may be introduced into the drilling fluid flow path, such as by dropping a drop ball into the drilling fluid flow path. In other embodiments, the obstruction may be initially positioned in the mechanical activation module 124 and configured to break one or more shear pins in response to high drilling fluid pressure to cause the mechanical activation module 124 to be activated.

By way of example and not limitation, if a mechanical activation module 124 is used that is activated by a drop ball, methods and apparatuses for drop ball activation of expandable reamer apparatuses are explained generally in, for example, U.S. patent application Ser. No. 12/715,610, titled "CHIP DEFLECTOR ON A BLADE OF A DOWNHOLE REAMER AND METHODS THEREFORE," filed Mar. 2, 2010, now U.S. Patent Publication No. 2010/00224414 A1, U.S. patent application Ser. No. 12/501,688, titled "STABILIZER SUBS FOR USE WITH EXPANDABLE REAMER APPARATUS, EXPANDABLE REAMER APPARATUS INCLUDING STABILIZER SUBS AND RELATED METHODS," filed Jul. 13, 2009, now U.S. Pat. No. 8,297,381, and U.S. patent application Ser. No. 11/949,259, titled "EXPANDABLE REAMERS FOR EARTH BORING APPLICATIONS," filed Dec. 3, 2007, now U.S. Pat. No. 7,900,717, the entire disclosure of each of which is incorporated by this reference herein. Such disclosures explain in general terms the concept of using drop balls to form an obstruction in a drilling fluid flow path to create a pressure differential, which may be used to mechanically move components of reamers, and are not listed to describe a specific, complete mechanism to be used with embodiments of the present disclosure. By way of another non-limiting example, a drop ball activation module that may be used as the mechanical activation module 124 of the present disclosure is disclosed in U.S. patent application Ser. No. 13/784,307, titled "ACTUATION ASSEMBLIES, HYDRAULICALLY ACTUATED TOOLS FOR USE IN SUBTERRANEAN BOREHOLES INCLUDING ACTUATION ASSEMBLIES AND RELATED METHODS," filed Mar. 4, 2013, now U.S. Patent Publication No. 2014/0246246 A1, assigned to the assignee of the present application, the entire disclosure of which is incorporated by this reference herein.

Regardless of the activation means by which the selected activation module 120 is activated, each of the activation modules 120 may include an axially movable activation member (e.g., an elongated tube, rod, or piston) that is configured to be coupled to and move a sleeve of the expandable reamer module 110 during operation, to move at least one reamer blade of the expandable reamer module 110 between a deactivated (e.g., retracted) position and an activated (e.g., extended, expanded) position. The activation module 120 of the present disclosure may be configured to be positioned above the expandable reamer module 110 and to pull a sleeve within the expandable reamer module 110 toward the activation module 120 and opposite a direction of flow of drilling fluid through the BHA or expandable reamer assembly during use of the BHA or expandable reamer assembly. Such a pulling motion may result in movement of at least one reamer blade of the expandable reamer module 110 into an expanded position.

Similarly, the expandable reamer module 110 may be configured to be interchangeably coupled to any of various stabilizer or linking modules 130, such as a linking module 132 without stabilizer blades or a stabilizer module 134 with stabilizer blades. A pilot bit 140 of any type (e.g., a drag bit, a diamond impregnated bit, a roller cone bit, etc.) may be interchangeably coupled with any of the stabilizer or linking modules 130. In other embodiments, the pilot bit 140 may be coupled directly to the expandable reamer module 110 without use of a separate stabilizer or linking module 130.

The expandable reamer module 110 may be configured to be activated (i.e., to expand one or more reamer blades thereof) indirectly by any of the activation modules 120, as will be explained in more detail below. In particular, the expandable reamer module 110 may be configured to be activated by an activation member of the activation module 120 pulling on a sleeve disposed within the expandable reamer module 110. Accordingly, the expandable reamer module 110 itself may lack any mechanism or device configured to be directly activated, and it may not be possible to activate the expandable reamer module 110 without the activation module 120. In addition, the expandable reamer module 110 may lack a spring therein configured to bias the expandable reamer module 110 to one of the activated and deactivated positions. Rather, activation of the expandable reamer module 110 may be accomplished by one of the separate activation modules 120 operatively coupled to the expandable reamer module 110. In other words, the expandable reamer module 110 may be a slave unit that reacts to activation and/or deactivation from one of the activation modules 120, which acts as a master unit for providing a motive force to the expandable reamer module 110.

Although only the activation modules 120, the expandable reamer module 110, the stabilizer or linking modules 130, and the pilot bit 140 are shown in the schematic 100 of FIG. 1 for simplicity of explanation, the present disclosure also includes BHAs having other possible combinations of modules, which may include additional or alternative modules or components. For example, a steering module, a downhole motor module, an expandable stabilizer module, or any other module may be interchangeably coupled with one or more of the modules described in detail herein to provide options for forming various BHAs, as desired.

Thus, a user may have several options for forming a BHA or expandable reamer assembly for a particular application. By way of example and not limitation, at one time the expandable reamer module 110 may be coupled to the mechanical activation module 124, such as when the expandable reamer module 110 is to be activated and deactivated relatively few times, or when cost is a limiting factor. The expandable reamer module 110, coupled to the mechanical activation module 124, and configured to be activated by a drop ball may be positioned in a borehole of a subterranean formation, and a drop ball may be dropped in drilling fluid to activate the mechanical activation module 124, which may result in the activation of the expandable reamer module 110. One or more reamer blades of the activated expandable reamer module 110 may engage the subterranean formation and remove material from the subterranean formation. The expandable reamer module 110 and the mechanical activation module 124 may be removed from the borehole, and the mechanical activation module 124 may be decoupled from the expandable reamer module 110.

In some embodiments, the expandable reamer module 110 may be maintained and/or modified after being removed from the borehole. For example: cutters may be replaced on a reamer blade; a first reamer blade may be replaced with a second, different reamer blade; or a first stop block configured to stop the reamer blade at a first position when activated may be replaced by a second stop block configured to stop the reamer blade at a second, different position when activated. Other components may be replaced or maintained to prepare the same expandable reamer module 110 to be reused with a same or a different activation module 120. As used herein, the phrase "the same expandable reamer module" refers to at least the same tubular body of the expandable reamer module. In some embodiments, "the same expandable reamer module" refers to retaining all the same components in addition to the tubular body thereof, such as an expandable reamer blade, a sleeve, a yoke, a stop block, etc. In other embodiments, one or more components of the expandable reamer module may be replaced, such as for maintenance or to modify a characteristic (e.g., cutting aggressiveness, reaming diameter) of the expandable reamer module, as described above. Although the expandable reamer module may include one or more components that are different, such a maintained or modified expandable reamer is also encompassed by the phrase "the same expandable reamer module," since at least the same tubular body is used.

At another time, a user may couple the same expandable reamer module 110 that was coupled to the mechanical activation module 124 to the electronic and hydraulic activation module 122. For example, the electrical and hydraulic activation module 122 may be used when the expandable reamer module 110 is to be activated and deactivated relatively many times, when more accurate and timely control over the activation and deactivation of the expandable reamer module 110 is desired, or when a drilling fluid flow path is obstructed in a manner that a drop ball cannot reach the activation module 120, such as by a so-called "measurement while drilling" (MWD) tool, a downhole motor, etc. The expandable reamer module 110 coupled to the electronic and hydraulic activation module 122 may be positioned in a borehole (e.g., the same borehole that was reamed previously with the expandable reamer module 110 while activated by the mechanical activation module 124, or a different borehole) in the subterranean formation. The electronic and hydraulic activation module 122 may be activated by receiving an electronic signal, which may cause the electrical and hydraulic activation module 122 to activate the expandable reamer module 110. One or more reamer blades of the activated expandable reamer module 110 may engage the subterranean formation and remove material from the subterranean formation.

Accordingly, the present disclosure includes a reusable expandable reamer module 110 that may be used with any of several separate activation modules 120. The activation module 120 to be used in a given situation may be selected based on, for example, one or more of cost considerations, formation characteristics, BHA configuration, and activation control. Manufacturing and maintaining the expandable reamer module 110 of the present disclosure may be less expensive than the manufacturing and maintaining of prior known expandable reamers that include activation mechanisms integral to the expandable reamers, due to a reduced number of components and/or a reduced complexity thereof.

In addition, a single design of the expandable reamer module 110 may be used with a relatively less expensive mechanical activation module 124 or with a relatively more expensive but potentially higher performance electronic and hydraulic activation device 122, without changing the design of the expandable reamer module 110.

In some embodiments, more than one reamer assembly (including an expandable reamer module 110 and an activation module 120) may be used in a BHA. For example, a first expandable reamer module 110 may be coupled to a first activation module 120 and positioned at a first location in the BHA (e.g., at a top of the BHA, at an initial location in a drilling fluid flow path passing through the BHA) and a second expandable reamer module 110 may be coupled to a second activation module 120 and positioned at a second location in the BHA (e.g., at a location in the BHA proximate the pilot bit 140, immediately adjacent to the pilot bit 140, at any location below the first location). The first and second expandable reamer modules 110 may be substantially identical to each other, while the first and second activation modules 120 may be different from each other. For example, the first and second activation modules 120 may be configured to be activated by different activation means. Thus, the first activation module 120 may be a mechanical activation module 124 configured to be activated by a drop ball and the second activation module 120 may be an electronic and hydraulic activation module configured to be activated by an electrical signal, drilling fluid force telemetry, a predetermined level of pressure in the drilling fluid, or a predetermined drilling fluid flow rate. During use, the second activation module 120 may be activated after the first activation module 120 even if a drop ball obstructs a fluid flow path to the second activation module 120 that would preclude a drop ball from reaching the second activation module 120.

The present disclosure also includes methods of using expandable reamer modules 110 to provide various options for one or more users. For example, a first expandable reamer module 110 including a tubular body and an axially movable sleeve within the tubular body may be provided. A first activation module 120 configured to be activated with a first activation means may also be provided. The first activation module 120 may include a tubular body configured to be coupled to the tubular body of the first expandable reamer module 110, as well as an axially movable activation member configured to be coupled to the sleeve of the first expandable reamer module 110. Thus, axial movement of the activation member may result in axial movement of the sleeve. The first expandable reamer module 110 and the first activation module 120 may be paired for used in a reaming process in which the first activation module 120 activates the first expandable reamer module 110 to ream a subterranean formation. A second expandable reamer module 110 may be provided that is substantially identical to the first expandable reamer module 110. A second activation module 120 configured to be activated with a second, different activation means may be provided. The second activation module 120 may include a tubular body configured to be coupled to the tubular body of the second expandable reamer module 110 and an axially movable activation member configured to be coupled to the sleeve of the second expandable reamer module 110. Thus, axial movement of the activation member may result in axial movement of the sleeve. The second expandable reamer module 110 and the second activation module 120 may be paired for use in a reaming process in which the second activation module 120 activates the second expandable reamer module 110 to ream a subterranean formation.

In some embodiments, the pairing of the first expandable reamer module 110 and the first activation module 120 may include coupling the tubular body of the first expandable reamer module 110 to the tubular body of the first activation module 120 and coupling the activation member of the first activation module 120 to the sleeve of the first expandable reamer module 110, as will be explained in more detail below.

Figure 2:
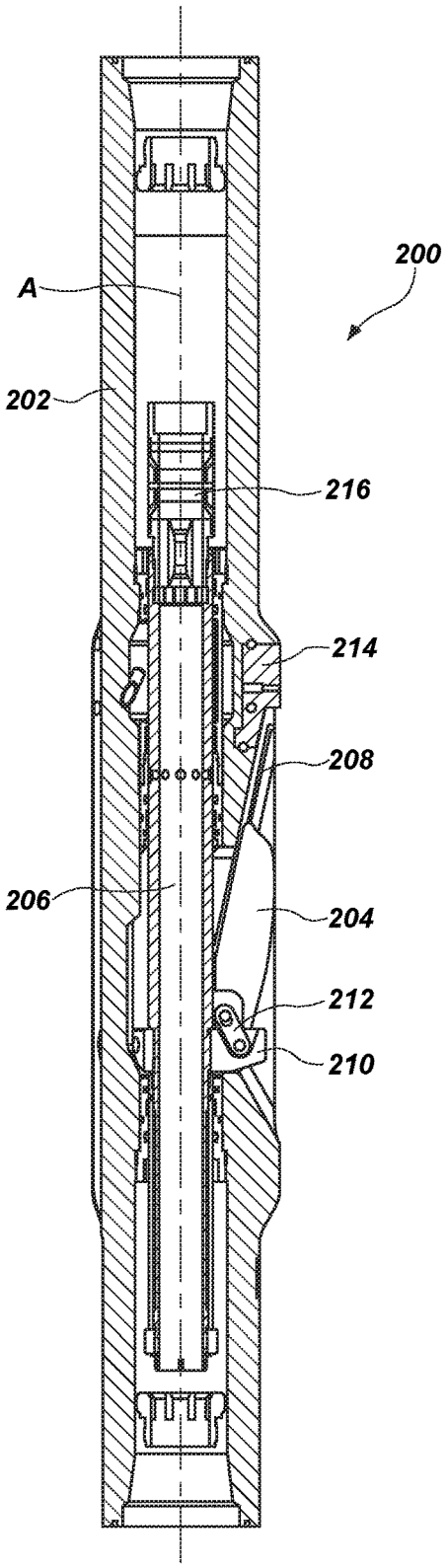
FIG. 2 shows a cross-sectional side view of an expandable reamer module in a deactivated position, according to an embodiment of the present disclosure.
Figure 3:
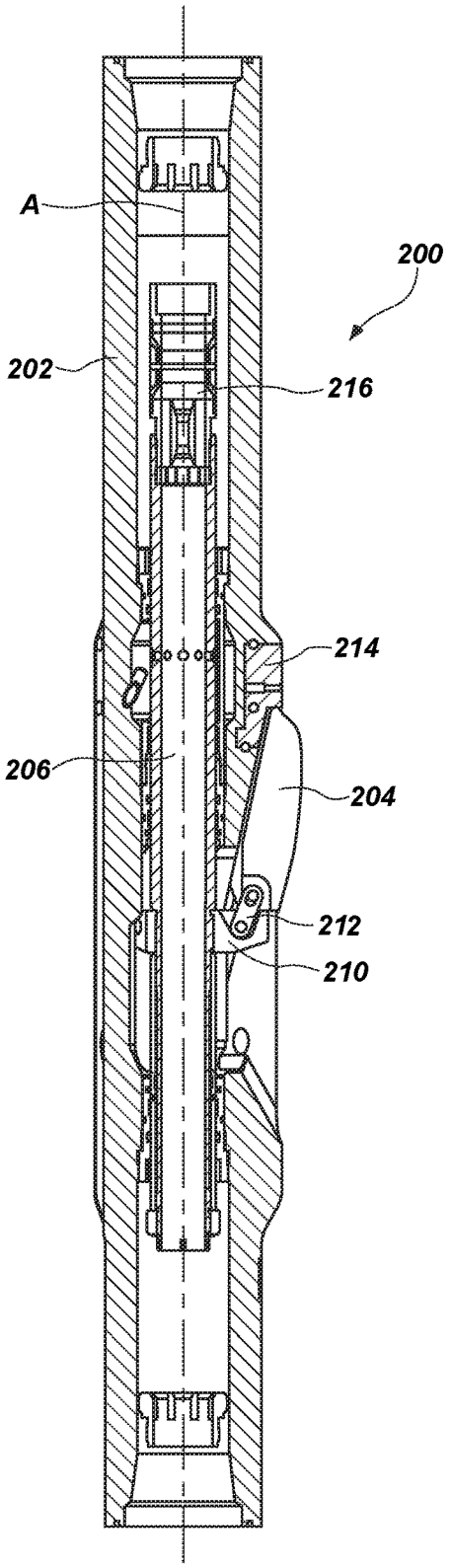
FIG. 3 shows a cross-sectional side view of the expandable reamer module of FIG. 2 in an activated position.

Referring to FIGS. 2 and 3, an embodiment of an expandable reamer module 200 is shown, which may be used as the expandable reamer module 110 of FIG. 1. FIG. 2 illustrates the expandable reamer module 200 in a deactivated position, which is also referred to herein as a retracted position, and FIG. 3 illustrates the expandable reamer module 200 in an activated position, which is also referred to herein as an expanded or extended position. The expandable reamer module 200 may include a tubular body 202 having an inner bore and an outer surface, at least one reamer blade 204, and a sleeve 206 (which may, in some embodiments, be characterized as a "push sleeve" for pushing the at least one reamer blade 204 into an expanded position). A drilling fluid flow path may extend through the inner bore of the tubular body 202. The tubular body 202 may include at least one track 208 along which the at least one reamer blade 204 is movable. The at least one track 208 may extend upward and outward between the inner bore of the tubular body 202 and an outer surface of the tubular body 202 at an acute angle to a longitudinal axis A of the expandable reamer module 200. The at least one reamer blade 204 may be slidably coupled to the at least one track 208 to enable the at least one reamer blade 204 to slide from a deactivated position (FIG. 2) to an activated position (FIG. 3). The sleeve 206 may be disposed at least partially within the tubular body 202 and may be movable along the longitudinal axis A between the deactivated position (FIG. 2) and the activated position (FIG. 3). The sleeve 206 may be coupled to the at least one reamer blade 204 such that axial movement of the sleeve 206 results in movement of the at least one reamer blade 204 along the at least one track 208. Although the sleeve 206 is illustrated in FIGS. 2 and 3 as being fully disposed within the tubular body 202, in other embodiments, the sleeve 206 may have a length sufficient to extend beyond a longitudinal end of the tubular body 202 in one or both of the deactivated position and the activated position.

A yoke 210 may be rigidly coupled to the sleeve 206, such as by one or more of threads, mechanical interference, and a weld, for example. The yoke 210 may be configured to force (e.g., push against) the at least one reamer blade 204 to slide the at least one reamer blade 204 along the at least one track 208 from the deactivated position toward the activated position. A rotatable link 212 may be used to couple the yoke 210 to the at least one reamer blade 204 to enable the yoke 210 to force (e.g., pull) and slide the at least one reamer blade 204 along the at least one track 208 from the activated position toward the deactivated position. In the activated position, the at least one expandable reamer blade 204 may rest against a stop block 214 positioned on the tubular body 202 proximate an end of the at least one track 208.

The expandable reamer module 200 may include any number of expandable reamer blades 204, such as one, two, three, four, or more than four. The yoke 210 may include a number of protrusions corresponding to the number of expandable reamer blades 204. Similarly, the tubular body 202 may include a number of tracks 208 corresponding to the number of expandable reamer blades 204. A number of stop blocks 214 corresponding to the number of expandable reamer blades 204 may be coupled to the tubular body 202.

As can be seen in FIGS. 2 and 3, a joint structure 216 may be coupled to a longitudinal end of the sleeve 206. The joint structure 216 may be configured to join the sleeve 206 to an activation member (e.g., an elongated tube, rod, or piston) of a separate activation module to transmit motive force to the sleeve 206, to axially move the sleeve 206 between the deactivated position and the activated position, as will be explained in more detail below. However, the expandable reamer module 200 itself may not include any mechanism or device configured to directly provide motive force to axially move the sleeve 206 between the deactivated position and the activated position. For example, the expandable reamer module 200 may lack a spring for biasing the sleeve 206 to an axial position, such as to either one of the deactivated position and the activated position. In addition, the expandable reamer module 200 may lack a mechanism or device configured to be directly activated by a drop ball, an RFID chip, drilling fluid force telemetry, increased drilling fluid pressure, increased drilling fluid flow rate, or an electrical signal, for example. Thus, no significant motive force is provided by the expandable reamer module 200 to move the at least one reamer blade 204 between the deactivated and activated positions. Accordingly, the expandable reamer module 200 may be more economical to manufacture and/or maintain than prior known expandable reamers that include such integral activation mechanisms or devices.

Details of the expandable reamer module 200 and its operation are described in more detail below with reference to FIGS. 4 through 10.

Figure 4:
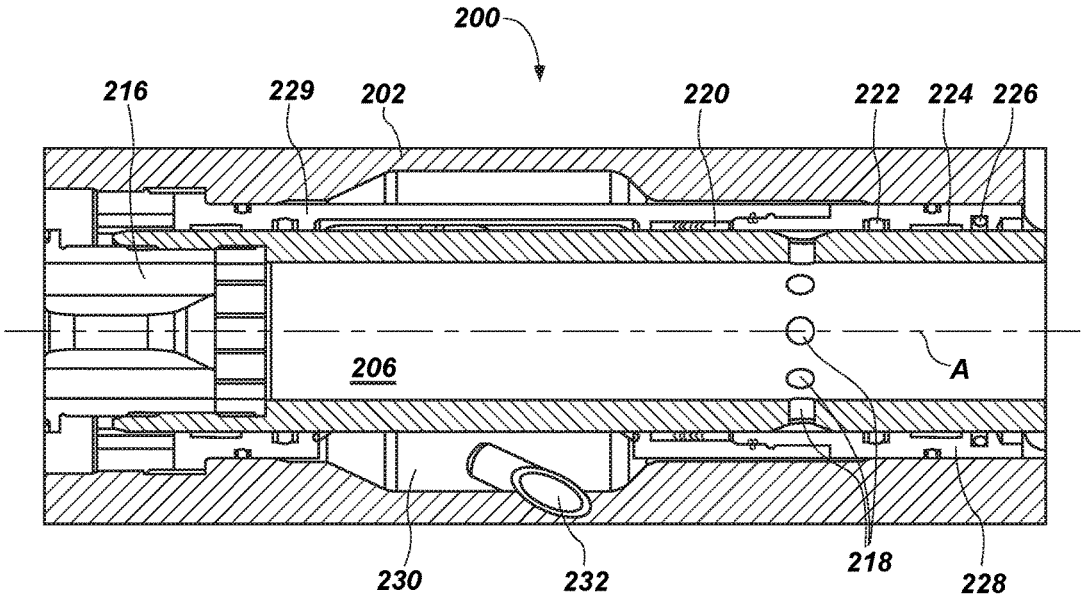
FIG. 4 shows a cross-sectional side view of an upper portion of the expandable reamer module of FIG. 2 in a deactivated position.
Figure 5:
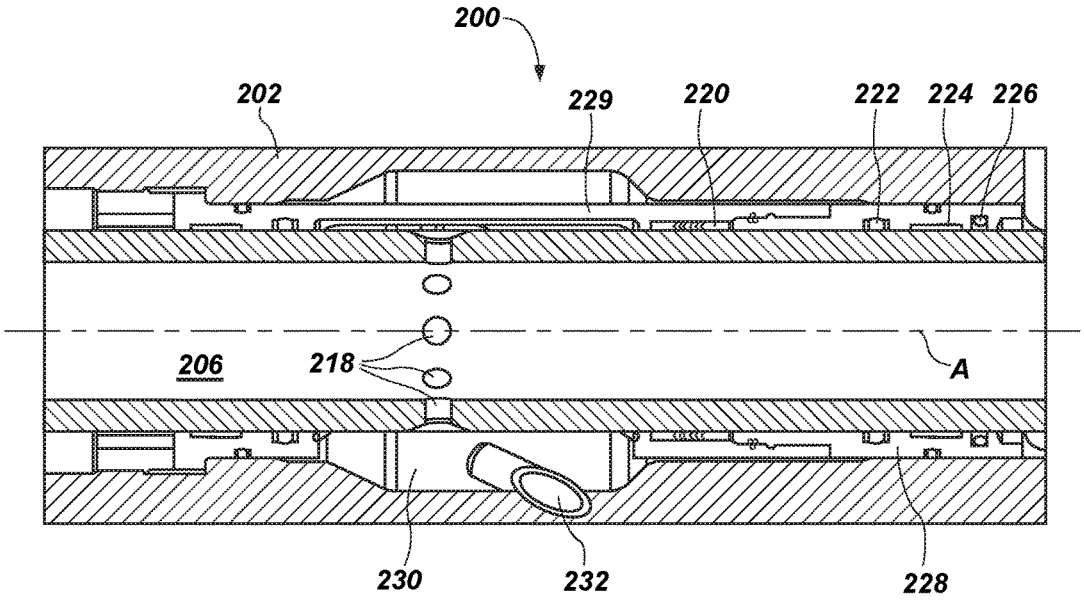
FIG. 5 shows a cross-sectional side view of the upper portion of the expandable reamer module of FIG. 2 in an activated position.

FIG. 4 illustrates an upper portion of the expandable reamer module 200 in the deactivated position, and FIG. 5 illustrates the upper portion in the activated position. The sleeve 206 may include one or more holes 218 through a sidewall thereof for providing fluid communication between an interior of the sleeve 206 and an exterior of the sleeve 206. During operation, drilling fluid may flow generally axially through the interior of the sleeve 206. In the deactivated position, the drilling fluid may be inhibited from flowing through the one or more holes 218 by one or more seals positioned proximate the exterior of the sleeve 206. For example, a first seal 220 and a second seal 222 (which may be an O-ring type seal) may be positioned on axially opposing sides of the one or more holes 218 when in the deactivated position. In addition, a centering ring 224 and a wiper ring 226 may be positioned proximate the exterior of the sleeve 206. The centering ring 224 may help maintain the sleeve 206 centrally within the tubular body 202. The wiper ring 226 may help clean the exterior of the sleeve 206 as it moves between the deactivated position and the activated position by forming a barrier that inhibits debris from passing the wiper ring 226. Each of the first seal 220, the second seal 222, the centering ring 224, and the wiper ring 226 may be held in place relative to the tubular body 202 by a seal sleeve 228 fixed to the interior of the tubular body 202. An upper guide sleeve 229 may also be positioned within and fixed to the interior of the tubular body 202 to provide further support to the sleeve 206 as the sleeve 206 moves axially, and/or to hold one or more additional seals and/or centering rings in place relative to the tubular body 202.

The first seal 220 may be a so-called "chevron seal," which includes a plurality of generally chevron-shaped portions when viewed in cross-section. As the sleeve 206 moves from the deactivated position to the activated position, the one or more holes 218 may pass from one axial side of the first seal 220 to another, opposite axial side of the first seal 220. In the activated position, drilling fluid may flow through the one or more holes 218 into a chamber 230 and ultimately through one or more nozzles 232 or holes extending through the tubular body 202. The drilling fluid may flow through the one or more nozzles 232 or holes to be directed at the one or more expandable reamer blades 204 (FIGS. 2 and 3) to cool the one or more expandable reamer blades 204, as will be explained in more detail below. Thus, as the one or more holes 218 pass across the first seal 220, drilling fluid may alternate between flowing through the one or more holes 218 and not flowing through the one or more holes 218.

In other embodiments, the first seal 220 may be omitted. In such embodiments, at least some drilling fluid may, during operation, continuously flow through the one or more holes 218 into the chamber 230 and through the one or more nozzles 232 or holes regardless of whether the sleeve 206 is in the deactivated or activated position. However, the drilling fluid may flow through the one or more holes 218 in the sleeve 206 at a lower rate when the sleeve 206 is in the deactivated position compared to the activated position due to the proximity of the seal sleeve 228 and/or the upper guide sleeve 229 to an outer surface of the sleeve 206.

The outer surface of the sleeve 206 may include a hard material to reduce wear on the sleeve 206 as the sleeve 206 moves axially and rubs against other components (e.g., the seal sleeve 228, the upper guide sleeve 229). By way of example and not limitation, the hard material may include one or more of a carbide material, a tungsten carbide material, a nitride material, a chrome material, a nickel plating material, a cobalt-chromium alloy material, and a STELLITE® material (a metal alloy available from Kennametal Inc. in Latrobe, Pa.). In some embodiments, the hard material may be formed on the outer surface of the sleeve 206 by a so-called "high velocity oxygen fuel (HVOF) spraying" technique (also referred to in the art as "high velocity oxy-fuel spraying" or "high velocity oxy-acetylene fuel spraying"), in which a hot, high velocity fluid jet produced by combustion of a fuel and oxygen is sprayed from a nozzle, and a powder feedstock of the hard material is fed into the jet. The hard material may at least partially melt when exposed to the high velocity fluid jet. The fluid jet including the hard material may be directed at the outer surface of the sleeve 206 to coat at least a portion of the sleeve 206 with the hard material. Such HVOF techniques may be used to form a hard, wear-resistant surface that is relatively smooth.

Figure 6:
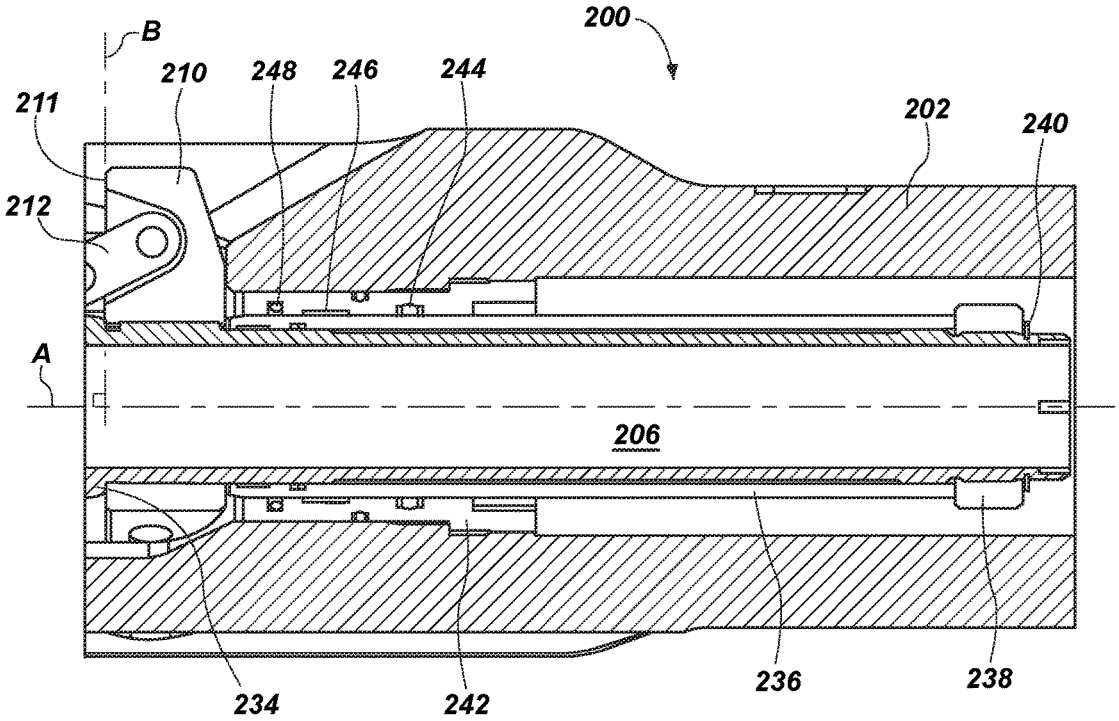
FIG. 6 shows a cross-sectional view of a lower portion of the expandable reamer module of FIG. 2 in a deactivated position.
Figure 7:
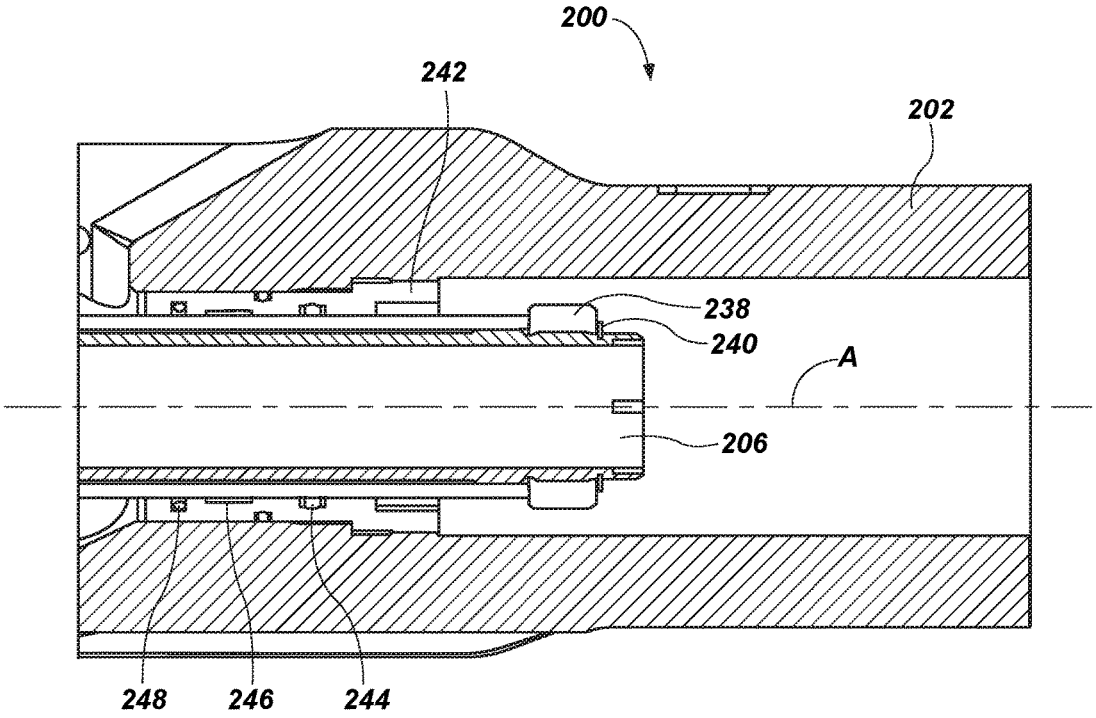
FIG. 7 shows a cross-sectional view of the lower portion of the expandable reamer module of FIG. 2 in an activated position.

FIG. 6 illustrates a lower portion of the expandable reamer module 200 in the deactivated position, and FIG. 7 illustrates the lower portion in the activated position. The terms "lower" and "upper," as used herein with reference to portions of the expandable reamer module 200 or another module, refer to the typical positions of the portions relative to one another when the expandable reamer module 200 or the another module is positioned within a wellbore. The yoke 210 may be coupled to (e.g., fixedly attached to) the sleeve 206 such that the yoke 210 moves axially as the sleeve 206 moves axially. The yoke 210 may be coupled to the sleeve 206 by one or more of threads, a weld, and mechanical interference. In the embodiment shown in FIG. 6, for example, the yoke 210 may be positioned around the sleeve 206 and held in place by abutting against an annular protrusion 234 formed on the outer surface of the sleeve 206 and by abutting against a wear sleeve 236 also positioned around the sleeve 206. The wear sleeve 236 may be coupled to (e.g., fixedly attached to) the sleeve 206 by positioning the wear sleeve 236 around the sleeve 206 and attaching a retaining member 238 to the sleeve 206 to hold the wear sleeve 236 in place relative to the sleeve 206. The retaining member 238 may be a threaded nut configured to be attached to the sleeve 206 with complementary threads formed on the outer surface of the sleeve 206. To ensure that the retaining member 238 does not come loose during operation, a retaining ring 240 may be positioned in a groove extending around the outer surface of the sleeve 206.

The yoke 210 may include a surface 211 proximate the one or more blades 204 (FIGS. 2 and 3). The surface 211 may push against the one or more blades 204 to slide the one or more blades 204 from the deactivated position to the activated position, as described above. In some embodiments, the surface 211 may generally extend in a plane B that is at least substantially perpendicular to the longitudinal axis A of the tubular body. In some embodiments, the surface 211 may generally extend at an angle to the longitudinal axis A toward the one or more blades 204. By providing the yoke 210 with the perpendicular or angled surface 211 in this manner, the one or more blades 204 may be positioned axially and radially further up the at least one track 208 (FIG. 2), compared to angling the surface 211 downward and away from the blades 204. Thus, the yoke 210 may be modified or a different yoke 210 may be provided to position the one or more blades 204 at a desired axial and radial position.

A lower guide sleeve 242 may be coupled (e.g., fixedly attached) to the tubular body 202 of the expandable reamer module 200. The wear sleeve 236 may be positioned such that the wear sleeve 236 slides within the lower guide sleeve 242 as the sleeve 206 moves along the longitudinal axis A between the deactivated position and the activated position. In addition, the wear sleeve 236 may be exposed to drilling fluid and possibly formation cuttings within the drilling fluid as the push sleeve 206 is moved into the activated position, since the wear sleeve 236 may be at least partially positioned in a slot that extends through the tubular body 202 in which the at least one reamer blade 204 (FIGS. 2 and 3) is positioned. The wear sleeve 236 may include a wear-resistant material to reduce wear that may result from rubbing against the lower guide sleeve 242 or from being exposed to the drilling fluid and formation cuttings. The wear sleeve 236 may also be configured to be replaceable, to avoid the cost of replacing the entire larger and potentially more expensive sleeve 206. The lower guide sleeve 242 may hold a lower seal 244, a lower centering ring 246, and a lower wiper ring 248 in place relative to the tubular body 202. The lower seal 244, lower centering ring 246, and lower wiper ring 248 may be similar in structure and function to the respective second seal 222, centering ring 224, and wiper ring 226 described above.

Figure 8:
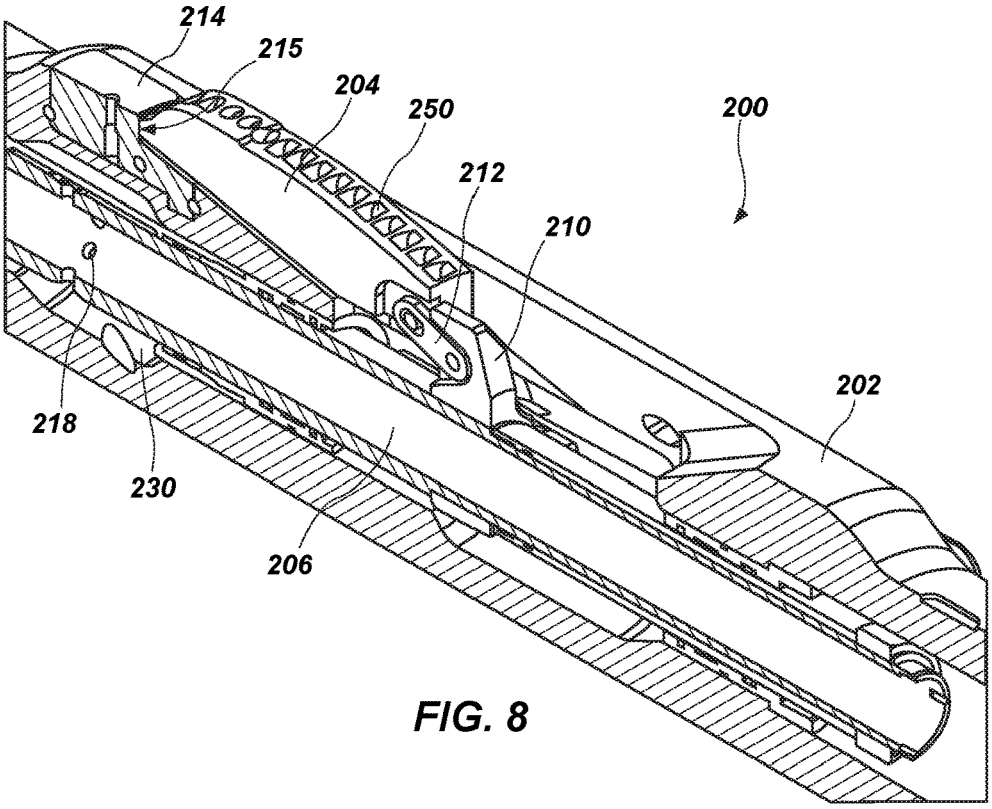
FIG. 8 shows a cross-sectional perspective view of a middle portion of the expandable reamer module of FIG. 2 in an activated position.
Figure 9:
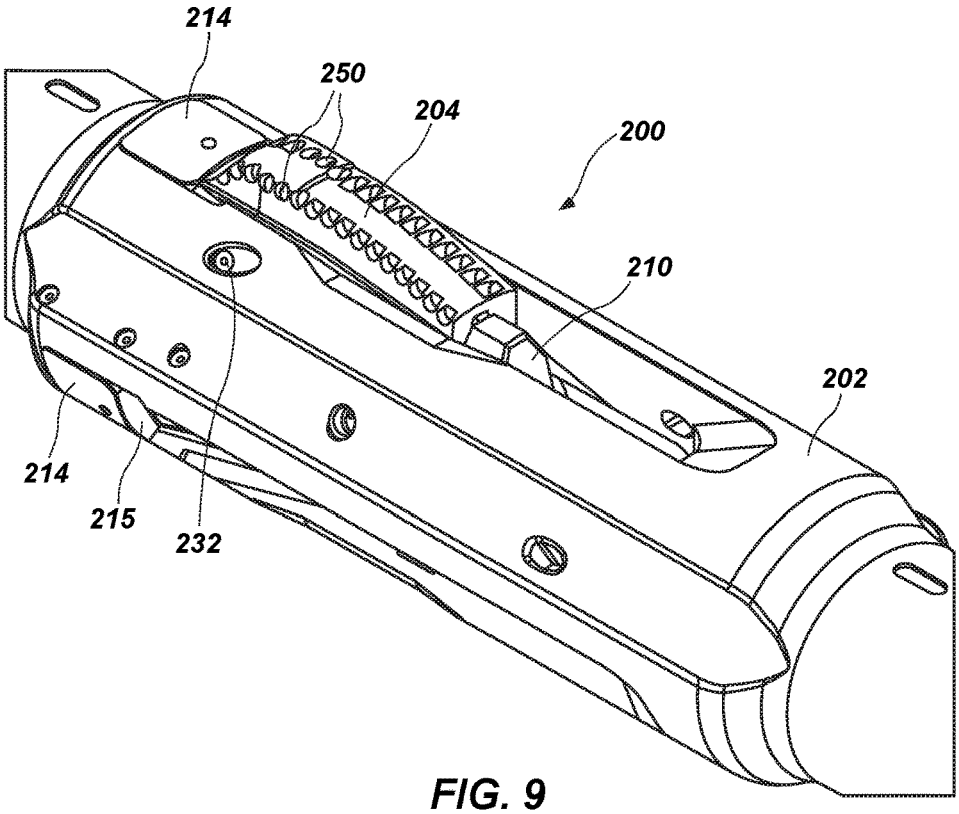
FIG. 9 shows a perspective view the middle portion of the expandable reamer module of FIG. 2 in an activated position.

FIG. 8 illustrates a cross-sectional perspective view of a middle portion of the expandable reamer module 200 in the activated position, and FIG. 9 illustrates a perspective view of the middle portion in the activated position. As explained above, in the activated position the one or more holes 218 of the sleeve 206 may allow drilling fluid to flow into the chamber 230 and through the one or more nozzles 232. As can be seen in FIG. 9, the one or more nozzles 232 may direct the drilling fluid toward the at least one reamer blade 204. The drilling fluid may be used to cool and clean the at least one reamer blade 204 and associated cutters as the at least one reamer blade 204 removes material from the subterranean formation. The at least one reamer blade 204 may include one or more cutter pockets 250 sized and shaped to receive one or more corresponding cutting elements therein. By way of example and not limitation, the cutting elements may be polycrystalline diamond compact (PDC) cutters or other cutting elements known to a person of ordinary skill in the art and as generally described in U.S. Pat. No. 7,036,611, titled "EXPANDABLE REAMER APPARATUS FOR ENLARGING BOREHOLES WHILE DRILLING AND METHODS OF USE," the entire disclosure of which is incorporated by reference herein.

In the activated position, the one or more reamer blades 204 may abut against a surface 215 of the one or more stop blocks 214. Thus, each stop block 214 may be configured to define a fully activated position by providing a stop at a desired location against which the at least one expandable reamer blade 204 may rest when fully activated. In addition, the one or more stop blocks 214 may be interchangeable to enable different stop blocks 214 to be used that have the surface 215 positioned at different axial positions. For example, the surface 215 of a first stop block 214 may be positioned at a first axial location along the tubular body 202 when installed, and the surface 215 of a second, different stop block 214 may be positioned at a second, different axial location along the tubular body 202 when installed. Accordingly, a distance that the at least one reamer blade 204 is allowed to travel along the at least one track 208 (FIGS. 2 and 3), and a radial distance that the at least one reamer blade 204 is extended, may be altered simply by replacing the first stop block 214 with the second, different stop block 214.

Figure 10:
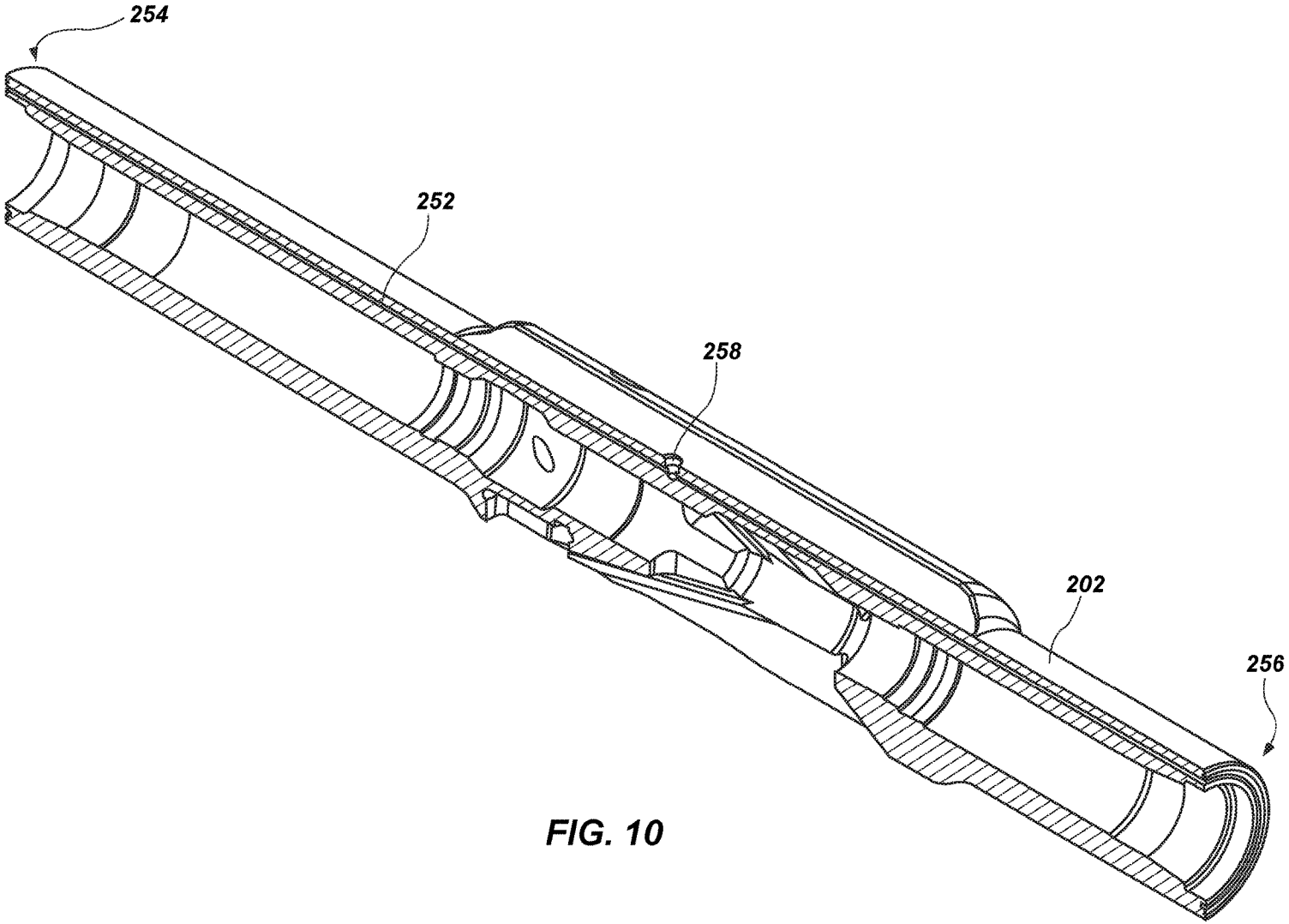
FIG. 10 shows a cross-sectional perspective view of a tubular body of the expandable reamer module of FIG. 2.

FIG. 10 illustrates the tubular body 202 with other components removed for simplicity. A wall of the tubular body 202 may comprise an elongated borehole 252 extending from a first longitudinal end 254 to a second longitudinal end 256 of the tubular body 202. The elongated borehole 252 may be substantially straight. The elongated borehole 252 may be provided as a conduit for an electrical wire, which may be used to transmit an electrical signal between the first longitudinal end 254 and the second longitudinal end 256 of the tubular body 202, such as to a module positioned in the borehole below the tubular body 202 that receives and/or sends an electrical signal through the electrical wire. The electrical wire may be encased in an electrically insulating material, such as a polymer material, to electrically isolate the electrical wire from the tubular body 202. A recess 258 may extend from an outer surface of the tubular body 202 to the elongated borehole 252. The elongated borehole 252 may enable the electrical wire to be isolated from the drilling fluid both inside the tubular body 202 and outside the tubular body 202, to inhibit potential damage to the electrical wire.

By way of example and not limitation, the elongated borehole 252 may be formed using a so-called "gun drilling" technique. A gun drill may include an elongated, straight-fluted drill bit and a fluid channel for providing a cutting fluid proximate a cutting face thereof. Gun drilling techniques may be used to form long, straight boreholes in metal or other material, such as the material of the tubular body 202. The elongated borehole 252 may be formed by gun drilling the tubular body 202 from the first longitudinal end 254 to the recess 258, then by gun drilling the tubular body 202 from the second longitudinal end 256 to the recess 258. Accordingly, a gun drill bit of only about half the length of the tubular body 202 may be used to form the elongated borehole 252. After the elongated borehole 252 is fully formed and an electrical wire is positioned therein, the recess 258 may be filled with a plug, to isolate the electrical wire from drilling fluid that may be present proximate the outer surface of the tubular body 202.

Figure 11:
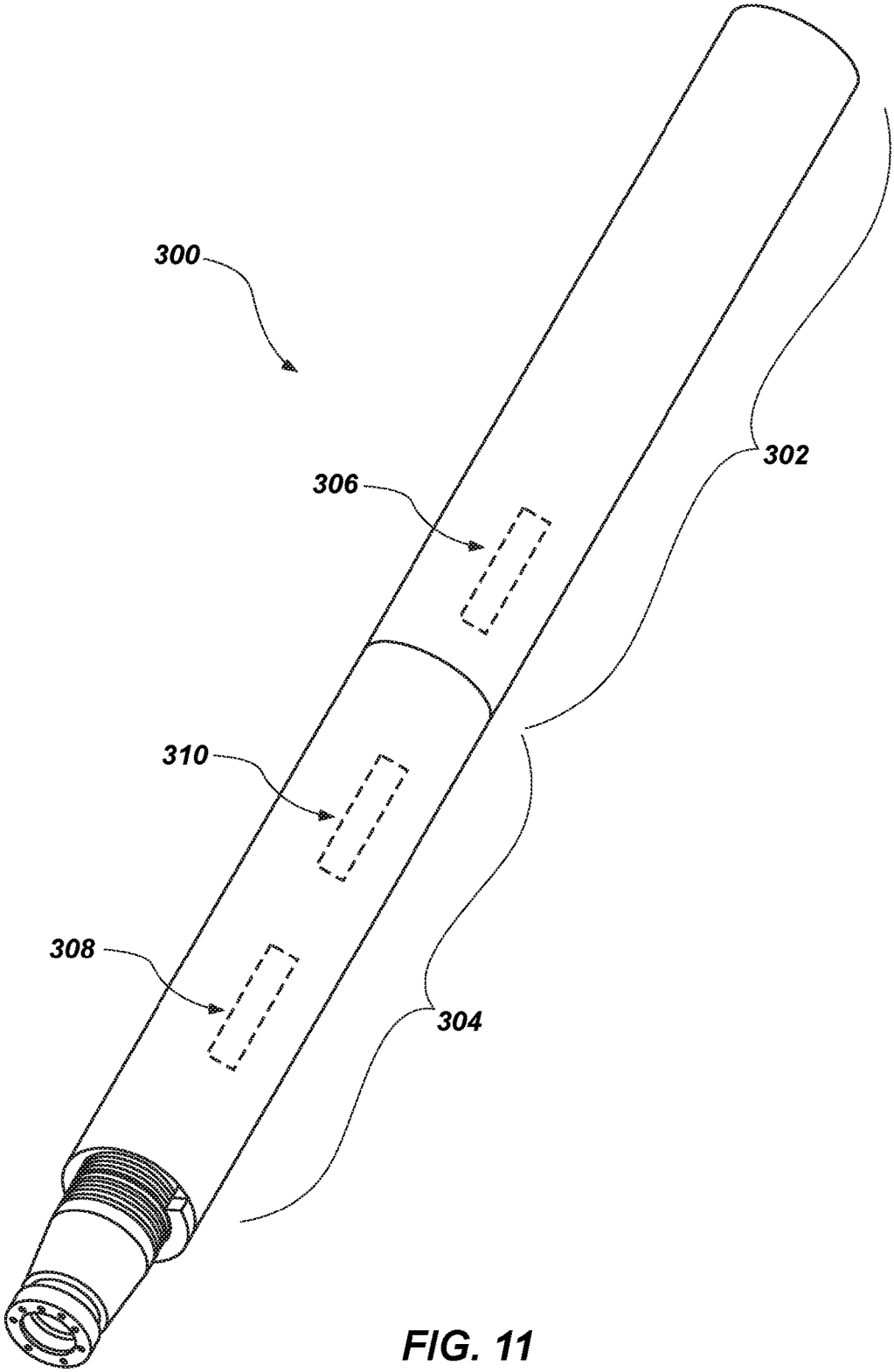
FIG. 11 shows a partially cut-away perspective view of an electronic and hydraulic component of an activation module, according to an embodiment of the present disclosure.
Figure 12:
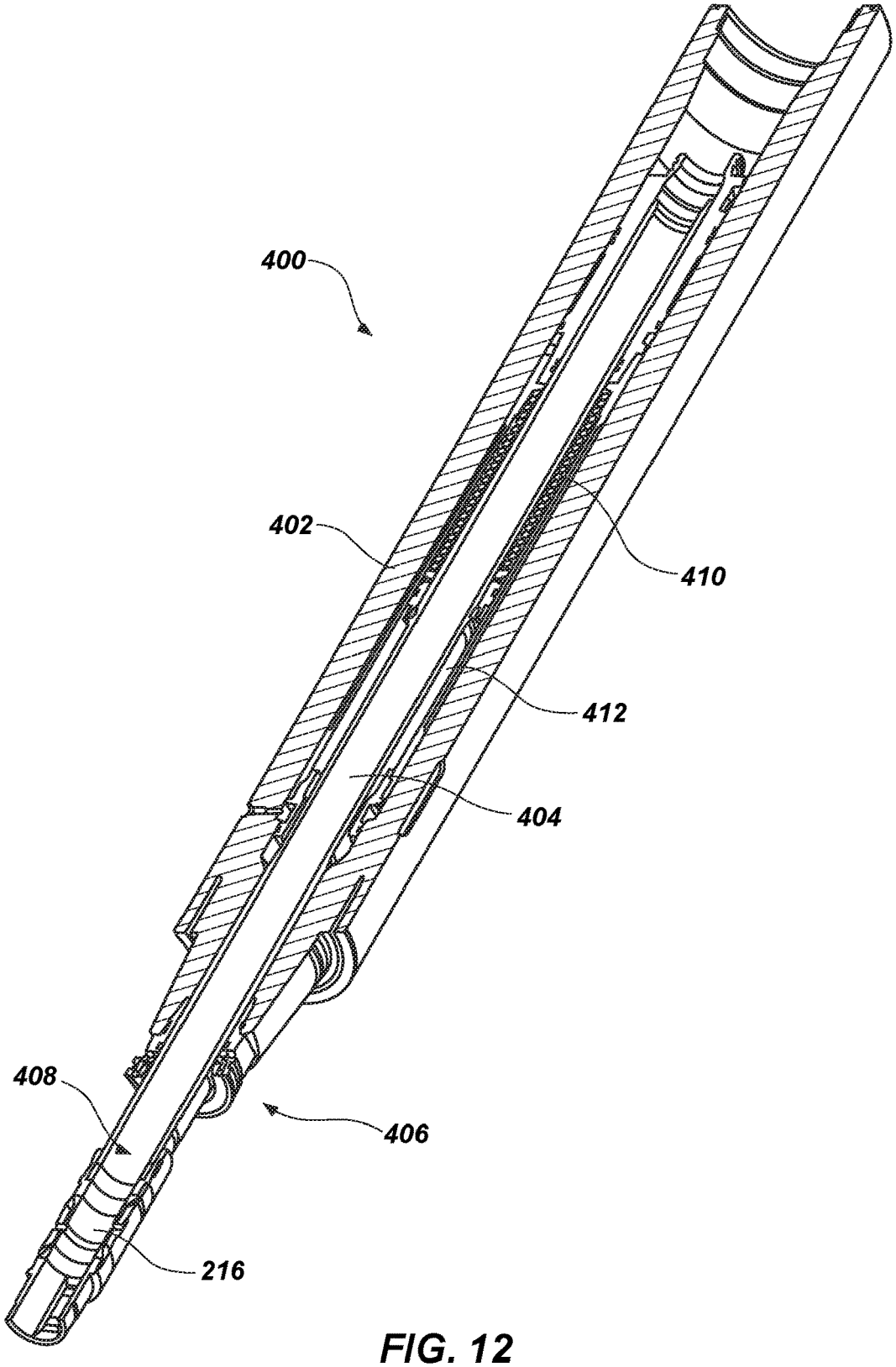
FIG. 12 shows a cross-sectional perspective view of a piston component of the activation module in an activated position, according to an embodiment of the present disclosure.

FIGS. 11 and 12 illustrate components of an activation module configured to provide a motive force to the sleeve 206 of the expandable reamer module 200 (see, e.g., FIGS. 2 and 3). The activation module may be used as the electronic and hydraulic activation module 122 of FIG. 1. The activation module may include an electronic and hydraulic component 300 (FIG. 11) and a piston component 400 (FIG. 12). For operation, the electronic and hydraulic component 300 and the piston component 400 may be operatively coupled together to form an electronic and hydraulic activation module.

The electronic and hydraulic component 300 may include an electronic portion 302 and a hydraulic portion 304. The electronic portion 302 may include electronic elements 306 (such as, for example, a processor, memory, a printed circuit board, etc.) configured to receive a signal to activate the activation module or to deactivate the activation module. The hydraulic portion 304 may include a hydraulic pump 308 and a motor 310 configured to control the operation of the hydraulic pump 308. For example, when the electronic portion 302 receives a signal to activate the activation module, the electronic portion 302 may drive the motor 310. The motor 310 may drive the hydraulic pump 308 to pump a hydraulic fluid to the piston component 400. The hydraulic fluid may be in a closed system separate from drilling fluid flowing through the assembly during use.

Referring to FIG. 12, the piston component 400 may include an outer tubular body 402. An activation member 404 (e.g., an elongated tube, rod, or piston) may be slidably coupled to the outer tubular body 402 and configured to slide axially between a deactivated position and an activated position (FIG. 12 showing the activated position). As shown in FIG. 12, the activation member 404 may extend past a longitudinal end 406 of the outer tubular body 402 of the piston module 400 during operation. A longitudinal end 408 of the activation member 404 may be coupled (e.g., attached) to the joint structure 216 to couple the activation member 404 to the sleeve 206 of the expandable reamer module 200 (see FIGS. 2 and 3). In addition, the longitudinal end 406 of the outer tubular body 402 of the piston component 400 may be coupled (e.g., screwed, welded, mechanically attached) to the tubular body 202 (FIGS. 2 and 3) of the expandable reamer module 200.

An end of a spring 410 may be coupled to the activation member 404 and another, opposite end of the spring 410 may be coupled to the outer tubular body 402 to bias the activation member 404 to a deactivated position. A piston chamber 412 may be provided around the activation member 404. Referring to FIG. 12 in conjunction with FIG. 11, hydraulic fluid from the hydraulic pump 308 may be pumped into the piston chamber 412 to provide a pressure differential and motive force to move the activation member 404 axially from the deactivated position to the activated position. When it is desired to move the activation member 404 from the activated position to the deactivated position, the pressure from the hydraulic pump 308 may be released and the spring 410 may push against the activation member 404, which may force the hydraulic fluid back into the hydraulic pump 308. In addition or alternatively, the hydraulic fluid may be pumped into a cavity housing the spring 410 to assist in the movement of the activation member 404 into the deactivated position. In such embodiments, the hydraulic fluid may be directed to either the piston chamber 412 or the cavity housing the spring 410 by a valve. As mentioned above, the hydraulic fluid may be in a closed system separate from the drilling fluid. Seals, centering rings, and wiper rings may be provided around the activation member 404, essentially as described above with reference to the expandable reamer module 200, as well as one or more wear sleeves, seal sleeves, guide sleeves, etc.

Figure 13:
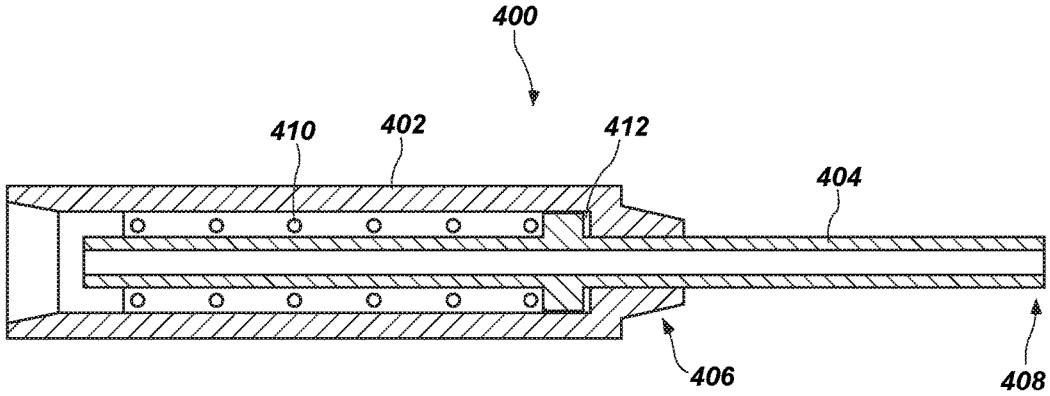
FIG. 13 shows a schematic cross-sectional view of the piston component of FIG. 12 in a deactivated position.
Figure 14:
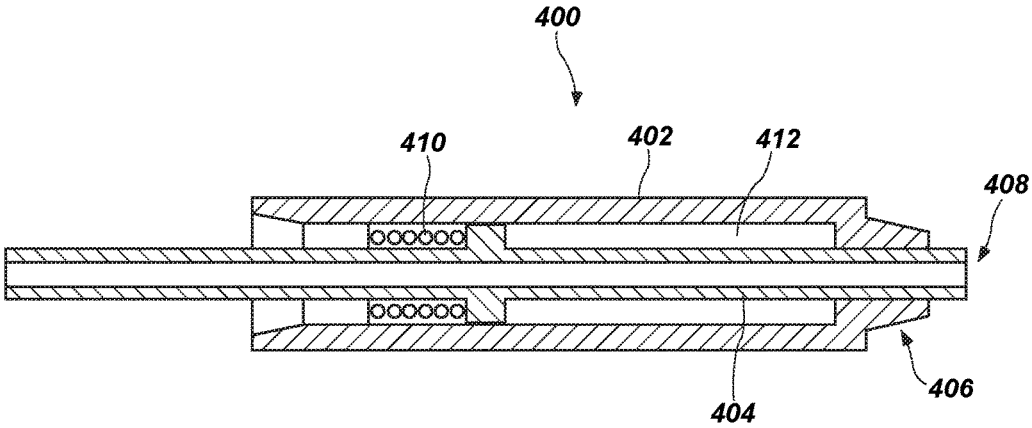
FIG. 14 shows a schematic cross-sectional side view of the piston component of FIG. 12 in an activated position.

Operation of the piston component 400 is shown schematically in FIGS. 13 and 14. FIG. 13 illustrates the piston component 400 in a deactivated position, and FIG. 14 illustrates the piston component 400 in an activated position. As shown in FIG. 13, without sufficient hydraulic fluid pressure in the piston chamber 412 to overcome the spring force, the spring 410 (and, optionally, any hydraulic fluid pressure in the cavity housing the spring 410) may bias the activation member 404 to the deactivated position. As shown in FIG. 14, if sufficient hydraulic fluid pressure is introduced into the piston chamber 412 to overcome the spring force (and, optionally, any hydraulic fluid pressure in the cavity housing the spring 410), the activation member 404 may be moved axially to the activated position. If the activation member 404 is coupled to the sleeve 206 of the expandable reamer module 200 (FIGS. 2 and 3), the activation member 404 may pull the sleeve 206 into the activated position, which may result in the at least one reamer blade 204 (FIGS. 2 and 3) sliding into the activated position, as well. If the pressure is released or reduced in the piston chamber 412, the spring force of the spring 410 (and, optionally, any hydraulic fluid pressure in the cavity housing the spring 410) may push the activation member 404 into the deactivated position (FIG. 13). If the activation member 404 is coupled to the sleeve 206, the sleeve 206 and the at least one reamer blade 204 may be pushed back into the deactivated position. Accordingly, the activation module may be used to provide a motive force to the sleeve 206, to activate and deactivate the expandable reamer module 200.

Although FIGS. 11 through 14 have been described with reference to the electronic and hydraulic component 300 providing hydraulic fluid to the piston chamber 412 in a closed hydraulic system, the present disclosure is not so limited. In other embodiments, the electronic and hydraulic component 300 may direct drilling fluid to the piston chamber 412 to drive movement of the activation member 404. In yet other embodiments, a mechanical component (e.g., a drop ball component) may direct drilling fluid to the piston chamber 412 to drive movement of the activation member 404. By way of example and not limitation, such a mechanical component (i.e., a ball drop component) is disclosed in the above-referenced U.S. patent application Ser. No. 13/784,307, titled "ACTUATION ASSEMBLIES, HYDRAULICALLY ACTUATED TOOLS FOR USE IN SUBTERRANEAN BOREHOLES INCLUDING ACTUATION ASSEMBLIES AND RELATED METHODS." As disclosed therein, multiple drop balls may be used to activate and deactivate such a mechanical component.

The activation member 404 of the activation module may be coupled to the sleeve 206 of the expandable reamer module 200 (FIGS. 2 and 3) in any manner that may enable the activation member 404 to both push and pull on the sleeve 206. By way of example and not limitation, the activation member 404 and the sleeve 206 may be mated with threads, locked together with a retaining rod, welded together, or coupled to one another by any other known method, as will be understood by one of ordinary skill in the art. By way of another example, the joint structure 216 described above may be used to couple the activation member 404 to the sleeve 206. In some embodiments, a longitudinal end of the joint structure 216 may be threaded to the sleeve 206 and the activation member 404 may be threaded to an opposing, longitudinal end of the joint structure 216. In some embodiments, torque may be applied to the activation member 404 prior to coupling the outer tubular body 402 of the piston component 400 to the tubular body 202 of the expandable reamer module 200. To provide space for a tool to grip the activation member 404, the sleeve 206 may be positioned in the activated position, and the activation member 404 may be positioned in the deactivated position. After the activation member 404 and the sleeve 206 are coupled to one another using the joint structure 216, the outer tubular body 402 of the piston component 400 may be coupled (e.g., threaded, welded) to the tubular body 202 of the expandable reamer module 200. After such coupling, both the activation member 404 and the sleeve 206 may be in the deactivated position in the absence of sufficient hydraulic pressure in the piston chamber 412. In other embodiments, the activation member 404 may be coupled to the sleeve 206 after coupling the outer tubular body 402 of the piston component 400 to the tubular body 202 of the expandable reamer module 200. In such embodiments, the joint structure 216 may be coupled to the activation member 404, and the outer tubular body 402 may then be coupled to the tubular body 202. Next, one or more elongated tools may be inserted into the assembly and engaged with the joint structure 216 and/or the sleeve 206. The one or more elongated tools may be used to apply a relative torque between the sleeve 206 and the joint structure 216.

Figure 15:
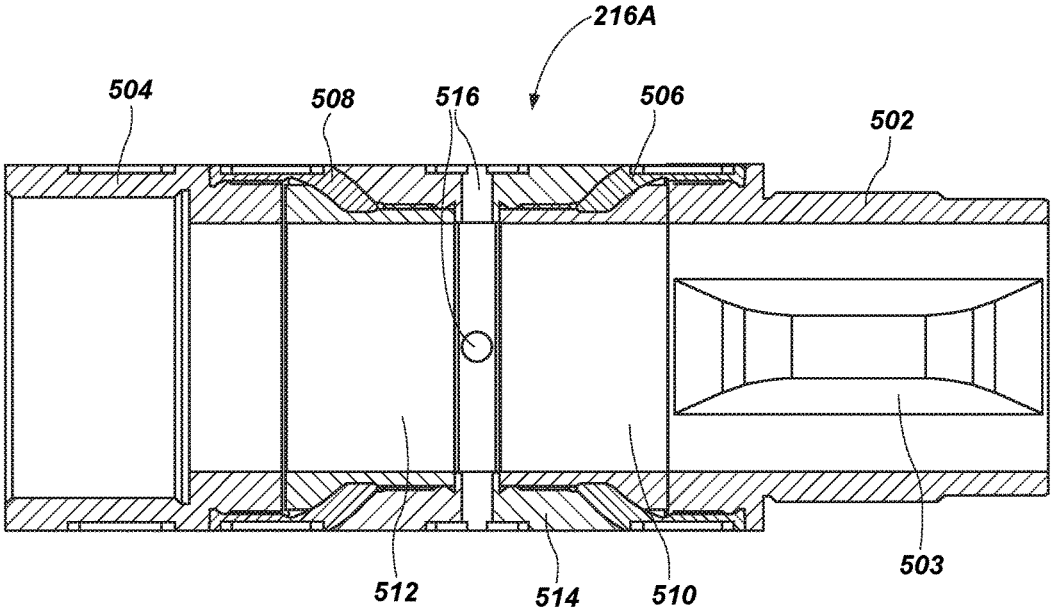
FIG. 15 shows a cross-sectional side view of a joint structure for coupling the activation module to the expandable reamer module according to an embodiment of the present disclosure.

FIG. 15 illustrates one embodiment of a joint structure 216A similar to the joint structure 216 described above. The joint structure 216A may include a sleeve link 502 at a first longitudinal end thereof for coupling the joint structure 216A to the sleeve 206 (FIG. 2). For example, the sleeve link 502 may include external threads and the sleeve 206 may include complementary internal threads for coupling the sleeve link 502 to the sleeve 206. The sleeve link 502 may also include one or more features 503 (e.g., protrusions, recesses) configured for engagement with one or more tools used to apply a torque to the sleeve link 502 to couple the sleeve link 502 to the sleeve 206. The joint structure 216A may also include a piston link 504 at a second longitudinal end thereof for coupling the joint structure 216A to the activation member 404 (FIG. 12). For example, the piston link 504 may include internal threads and the activation member 404 may include complementary external threads for coupling the piston link 504 to the activation member 404.

A first curved element 506 may be coupled to the sleeve link 502 and a second curved element 508 may be coupled to the piston link 504. First and second retaining members 510 and 512 may also be coupled to the respective sleeve link 502 and piston link 504 radially inward from the first and second curved elements 506, 508. A portion of the first and second retaining members 510 and 512 may be disposed between a longitudinal end of the respective sleeve link 502 and piston link 504 and an inner surface of the respective first and second curved elements 506 and 508. A third retaining member 514 may be coupled to both the first and second retaining members 510 and 512, such as by being threaded onto the first and second retaining members 510 and 512. The third retaining member 514 may be disposed along an outer surface of both the first and second curved elements 506 and 508. Thus, a longitudinal end of the first curved element 506 may be disposed in a volume defined between a portion of the first retaining member 510 and a portion of the third retaining member 514, and a longitudinal end of the second curved element 508 may be disposed in a volume defined between a portion of the second retaining member 512 and another portion of the third retaining member 514. The first and second curved members 506, 508 may be at least somewhat movable relative to the third retaining member 514. Configured in this manner, the joint structure 216A may allow for some misalignment between the activation member 404 and the sleeve 206 without causing undue mechanical stress at an interface between the activation member 404 and sleeve 206. The third retaining member 514 may, optionally, include one or more holes 516 extending therethrough to provide fluid communication between the interior of the joint structure 216A and an exterior of the joint structure 216A.

Figure 16:
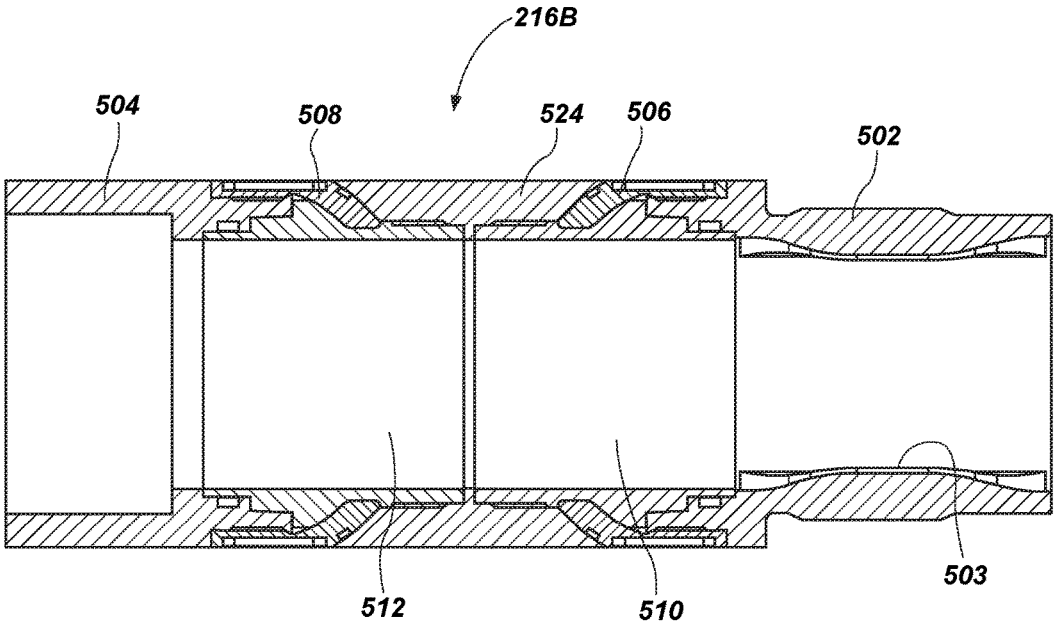
FIG. 16 shows a cross-sectional side view of a joint structure for coupling the activation module to the expandable reamer module according to another embodiment of the present disclosure.

FIG. 16 illustrates another embodiment of a joint structure 216B similar to the joint structures 216 and 216A described above. For example the joint structure 216B may include the sleeve link 502, the piston link 504, the first and second curved elements 506 and 508, and the first and second retaining members 510 and 512, essentially as described above with reference to the joint structure 216A. In addition, a fourth retaining member 524 may be similar to the third retaining member 514 described above, except the fourth retaining member 524 of the joint structure 216B may not include any holes 516 extending therethrough. Accordingly, the joint structure 216B of FIG. 16 may not allow any significant fluid communication between an interior and an exterior thereof.

Figure 17:
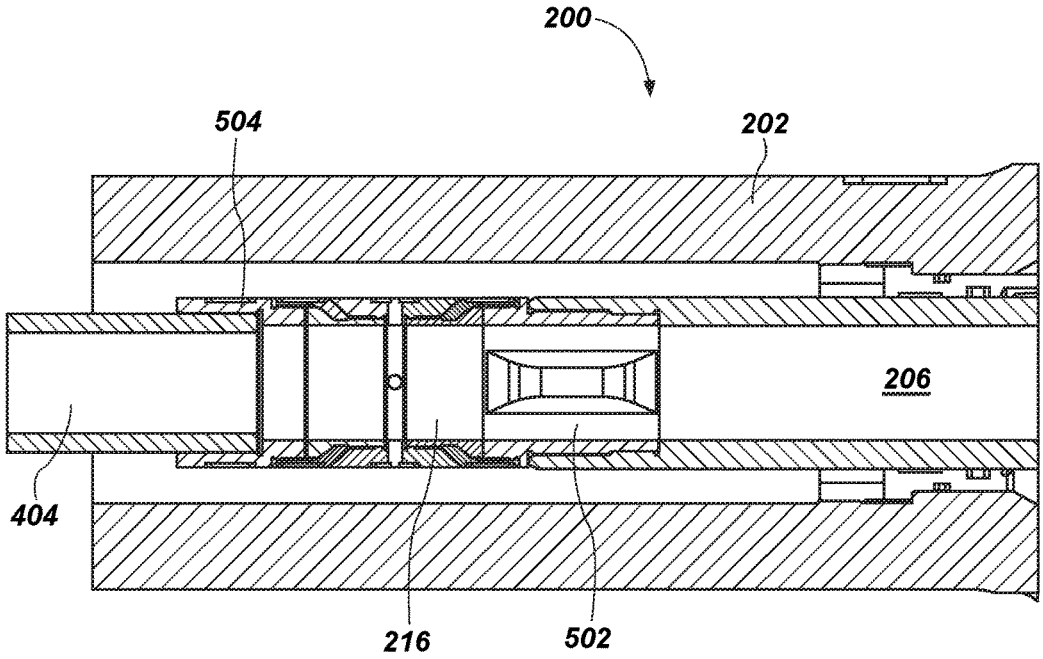
FIG. 17 shows a cross-sectional side view of an upper portion of the expandable reamer module of FIG. 2 with the joint structure of FIG. 15 coupled to a sleeve of the expandable reamer module and a piston of the activation module.

Referring to FIG. 17, the sleeve 206 of the expandable reamer module 200 may be coupled to a first longitudinal end of the joint structure 216 using the sleeve link 502, as described above. The activation member 404 of the activation module may be coupled to a second, opposite longitudinal end of the joint structure 216 using the piston link 504, as described above. Accordingly, the activation member 404 and the sleeve 206 may be coupled to each other using the joint structure 216, and the activation member 404 may move axially to cause the sleeve 206 to move axially as a result.

Figure 18:
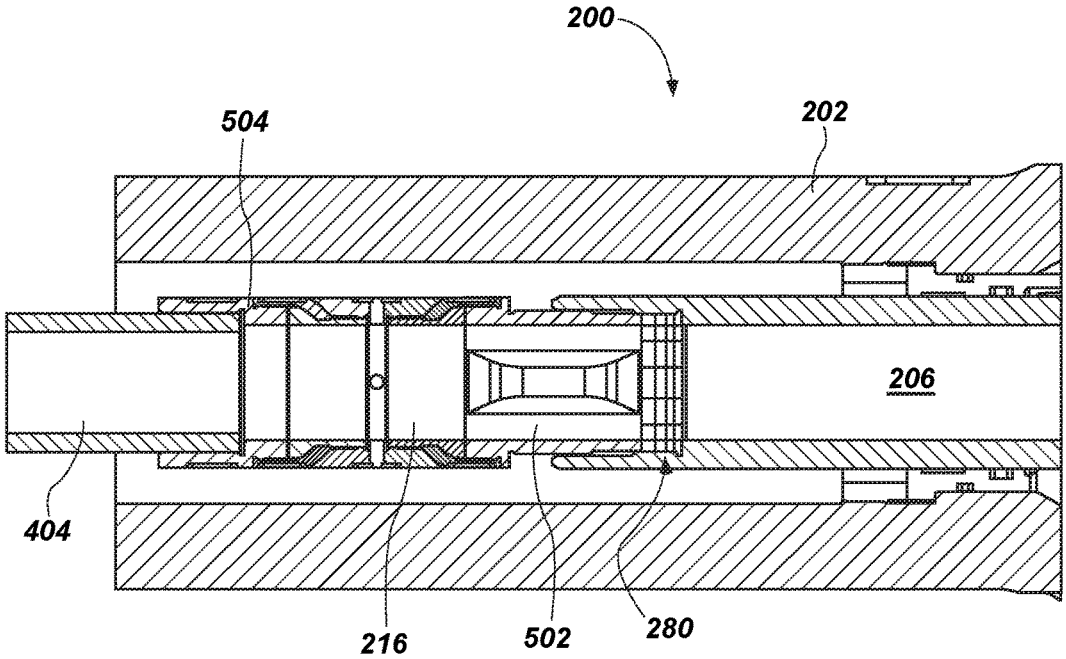
FIG. 18 shows an enlarged cross-sectional side view of the upper portion of the expandable reamer module similar to FIG. 17, but illustrating an addition of one or more spacers to position the joint of FIG. 15 at a desired location relative to the sleeve.

In some embodiments, the tubular body 202 of the expandable reamer module 200 may have a variable length. For example, threads of the outer tube 202 for coupling to the outer tubular body 402 of the piston component 400 (FIGS. 13 and 14) of the activation module may be re-cut to remove defects in the threads caused by damage to the threads during operation. Such re-cutting may alter a length of the tubular body 202. Thus, when the activation module is coupled to the expandable reamer module 200 with the re-cut threads, the activation member 404 may be relatively closer to the sleeve 206, which may cause difficulties in coupling the activation member 404 to the sleeve 206 without any modification. Accordingly, FIG. 18 illustrates a structure similar to that shown in FIG. 17, except one or more spacers 280 are positioned between the first longitudinal end of the joint structure 216 and the sleeve 206. The one or more spacers 280 may be disposed in this position, and the corresponding length of the sleeve 206 and/or of the activation member 404 may be selected, prior to a first use of the expandable reamer module 200 to ream a subterranean borehole. Thus, a distance between the longitudinal end of the activation member 404 and the longitudinal end of the sleeve 206 may be at least partially defined by the one or more spacers 280. For example, the distance may be increased by the addition of at least one spacer 280, or may be decreased by the removal of at least one spacer 280. If the threads on the longitudinal end of the tubular body 202 of the expandable reamer module 200 (and/or complementary threads on the activation module) are re-cut, or the length of the tubular body 202 is otherwise shortened, at least one of the one or more spacers 280 may be removed prior to coupling the activation member 404 to the sleeve 206 with the joint structure 216. Thus, the shortened length of the tubular body 202 may be compensated for and difficulties of re-coupling the activation member 404 to the sleeve 206 (or of coupling another piston of another, different activation module) may be reduced or avoided.

Additional non-limiting example embodiments of the present disclosure are set forth below.

Embodiment 1

An expandable reamer assembly for reaming a subterranean borehole, the expandable reamer module comprising: an expandable reamer module comprising: a tubular body having a longitudinal axis and an inner bore; one or more blades, at least one blade coupled to the tubular body and configured to move between a retracted position and an extended position; and a sleeve disposed within the inner bore of the tubular body and coupled to the at least one blade, the sleeve configured to axially move relative to the tubular body to move the at least one blade into the extended position; and an activation module comprising: an outer tubular body rigidly coupled to the tubular body of the expandable reamer module, the outer tubular body of the activation module having an inner bore; and an activation member at least partially disposed within the inner bore of the outer tubular body of the activation module, a longitudinal end of the activation member coupled to the sleeve to axially move the sleeve relative to the tubular body of the expandable reamer module responsive to axial movement of the activation member.

Embodiment 2

The expandable reamer assembly of Embodiment 1, wherein each blade of the one or more blades includes at least one cutting element configured to remove material from a subterranean formation during reaming.

Embodiment 3

The expandable reamer assembly of any one of Embodiments 1 and 2, wherein the expandable reamer module lacks a spring for biasing the sleeve to an axial position.

Embodiment 4

The expandable reamer assembly of any one of Embodiments 1 through 3, further comprising a yoke coupled to the sleeve, the yoke positioned to force the at least one blade into the extended position upon axial movement of the sleeve toward the activation module.

Embodiment 5

The expandable reamer assembly of Embodiment 4, wherein the yoke comprises a surface proximate the at least one blade, the surface extending in a plane at least substantially perpendicular to the longitudinal axis of the body.

Embodiment 6

The expandable reamer assembly of any one of Embodiments 1 through 5, wherein the sleeve comprises one or more holes extending through a sidewall thereof.

Embodiment 7

The expandable reamer assembly of Embodiment 6, further comprising at least one seal surrounding the sleeve and positioned proximate the one or more holes extending through the sidewall of the sleeve, the at least one seal configured to inhibit drilling fluid from flowing through the one or more holes when the sleeve is in a first, deactivated position and to allow the drilling fluid to flow through the one or more holes when the sleeve is in a second, activated position.

Embodiment 8

The expandable reamer assembly of any one of Embodiments 1 through 7, wherein an outer surface of the sleeve comprises one or more of carbide material, a tungsten carbide material, a nitride material, a chrome material, a nickel plating material, and a cobalt-chromium alloy material.

Embodiment 9

A bottom-hole assembly, comprising: an expandable reamer module comprising a first tubular body, at least one reamer blade movably coupled to the first tubular body, and a sleeve axially movable within the first tubular body, the sleeve coupled to the at least one reamer blade and configured to move the at least one reamer blade into an expanded position; and an activation module comprising a second tubular body rigidly coupled to the first tubular body of the expandable reamer module and an activation member coupled to the sleeve, the activation member configured to provide a motive force to the sleeve to move the sleeve toward the activation module and opposite a direction of flow of drilling fluid through the bottom-hole assembly during use of the bottom-hole assembly resulting in movement of the at least one reamer blade into the expanded position.

Embodiment 10

The bottom-hole assembly of Embodiment 9, wherein the activation module further comprises a spring positioned to bias the activation member to a deactivated axial position.

Embodiment 11

The bottom-hole assembly of any one of Embodiments 9 and 10, further comprising a joint structure positioned between the activation member and the sleeve.

Embodiment 12

The bottom-hole assembly of Embodiment 11, wherein the activation member is attached to a first longitudinal end of the joint structure and the sleeve is attached to a second longitudinal end of the joint structure.

Embodiment 13

The bottom-hole assembly of any one of Embodiments 11 and 12, further comprising at least one spacer positioned to at least partially define a distance between a longitudinal end of the activation member and a longitudinal end of the sleeve.

Embodiment 14

The bottom-hole assembly of any one of Embodiments 9 through 13, wherein the activation module comprises an electronic and hydraulic component configured to receive a signal and respond to the signal by causing hydraulic fluid to move the activation member between a deactivated axial position to an activated axial position.

Embodiment 15

A method of reaming a subterranean formation, comprising: coupling a first activation module to an expandable reamer module, the first activation module configured to be activated with a first activation means; activating the first activation module with the first activation means to activate the expandable reamer module; removing material from the subterranean formation using the expandable reamer module while activated by the first activation module; decoupling the first activation module from the expandable reamer module; coupling a second activation module to the expandable reamer module, the second activation module configured to be activated with a second, different activation means; activating the second activation module with the second activation means to activate the expandable reamer module; and removing material from the subterranean formation using the expandable reamer module while activated by the second activation module.

Embodiment 16

The method of Embodiment 15, further comprising, after removing material from the subterranean formation using the expandable reamer module while activated by the first activation module and prior to removing material from the subterranean formation using the expandable reamer module while activated by the second activation module: removing a first stop block from the expandable reamer module, the first stop block configured to stop a reamer blade of the expandable reamer module at a first position; and replacing the first stop block with a second stop block configured to stop the reamer blade at a second, different position.

Embodiment 17

The method of any one of Embodiments 15 and 16, further comprising, after removing material from the subterranean formation using the expandable reamer module while activated by the first activation module and prior to removing material from the subterranean formation using the expandable reamer module while activated by the second activation module: removing a first reamer blade from the expandable reamer module; and replacing the first reamer blade with a second, different reamer blade.

Embodiment 18

The method of any one of Embodiments 15 through 17, wherein coupling a first activation module to an expandable reamer module comprises coupling an activation member of the first activation module to a sleeve of the expandable reamer module.

Embodiment 19

The method of Embodiment 18, wherein coupling the activation member of the first activation module to a sleeve of the expandable reamer module comprises coupling the activation member to a first longitudinal end of a joint structure and coupling the sleeve to a second, opposite longitudinal end of the joint structure.

Embodiment 20

The method of any one of Embodiments 15 through 19, wherein each of activating the first activation module and activating the second activation module comprises activating the respective activation module with a respective activation means selected from the group consisting of a drop ball, a radio-frequency identification (RFID) chip, drilling fluid force telemetry, increased drilling fluid pressure, increased drilling fluid flow rate, and an electrical signal.

Embodiment 21

A method of using expandable reamer modules, the method comprising: providing a first expandable reamer module comprising a tubular body and an axially movable sleeve at least partially within the tubular body; providing a first activation module comprising a tubular body configured to be coupled to the tubular body of the first expandable reamer module and an axially movable activation member configured to be coupled to the sleeve of the first expandable reamer module such that axial movement of the activation member results in axial movement of the sleeve, the first activation module configured to be activated with a first activation means; pairing the first expandable reamer module and the first activation module for use in a reaming process in which the first activation module activates the first expandable reamer module to ream a subterranean formation; providing a second expandable reamer module comprising a tubular body and an axially movable sleeve at least partially within the tubular body, the second expandable reamer module substantially identical to the first expandable reamer module; providing a second activation module comprising a tubular body configured to be coupled to the tubular body of the second expandable reamer module and an axially movable activation member configured to be coupled to the sleeve of the second expandable reamer module such that axial movement of the activation member results in axial movement of the sleeve, the second activation module configured to be activated with a second, different activation means; and pairing the second expandable reamer module and the second activation module for use in a reaming process in which the second activation module activates the second expandable reamer module to ream a subterranean formation.

Embodiment 22

The method of Embodiment 21, further comprising: providing a third activation module comprising a tubular body configured to be coupled to the tubular body of the first expandable reamer module and an axially movable activation member configured to be coupled to the sleeve of the first expandable reamer module such that axial movement of the activation member results in axial movement of the sleeve, the third activation module configured to be activated with a third activation means different from the first activation means; and pairing the first expandable reamer module and the third activation module for use in a reaming process in which the third activation module activates the first expandable reamer module to ream a subterranean formation.

Embodiment 23

The method of any one of Embodiments 21 and 22, wherein providing a first expandable reamer module comprises providing a first expandable reamer module lacking an internal spring for biasing the sleeve to any axial position.

Embodiment 24

The method of any one of Embodiments 21 through 23, wherein pairing the first expandable reamer module and the first activation module comprises coupling the tubular body of the first expandable reamer module to the tubular body of the first activation module and coupling the activation member of the first activation module to the sleeve of the first expandable reamer module.

Embodiment 25

The method of Embodiment 24, wherein coupling the activation member of the first activation module to the sleeve of the first expandable reamer module comprises coupling the activation member to a first longitudinal end of a joint structure and coupling the sleeve to a second, opposite longitudinal end of the joint structure.

Embodiment 26

The method of any one of Embodiments 21 through 25, wherein each of providing a first activation module configured to be activated with a first activation means and providing a second activation module configured to be activated with a second, different activation means comprises providing the respective activation module configured to be activated with a respective activation means selected from the group consisting of a drop ball, a radio-frequency identification (RFID) chip, drilling fluid force telemetry, increased drilling fluid pressure, increased drilling fluid flow rate, and an electrical signal.

Embodiment 27

A bottom-hole assembly comprising: a first expandable reamer module comprising a first tubular body, at least one reamer blade movably coupled to the first tubular body, and a first sleeve axially movable within the first tubular body, the first sleeve configured to move the at least one reamer blade into an expanded position; a first activation module comprising a second tubular body rigidly coupled to the first tubular body of the first expandable reamer module and a first activation member coupled to the first sleeve, the first activation member configured to be activated by a first activation means and configured to provide a motive force to the first sleeve to axially move the first sleeve; a second expandable reamer module comprising a third tubular body, at least one reamer blade movably coupled to the third tubular body, and a second sleeve axially movable within the third tubular body, the second sleeve configured to move the at least one reamer blade into an expanded position; and a second activation module comprising a fourth tubular body rigidly coupled to the third tubular body of the second expandable reamer module and a second activation member coupled to the second sleeve, the second activation member configured to be activated by a second activation means different from the first activation means and configured to provide a motive force to the second sleeve to axially move the second sleeve.

The embodiments of the disclosure described above and illustrated in the accompanying drawing figures do not limit the scope of the invention, since these embodiments are merely examples of embodiments of the disclosure. The invention is defined by the appended claims and their legal equivalents. Any equivalent embodiments lie within the scope of this disclosure. Indeed, various modifications of the present disclosure, in addition to those shown and described herein, such as alternative useful combinations of the elements described, will become apparent to those of ordinary skill in the art from the description. Such modifications and embodiments also fall within the scope of the appended claims and their legal equivalents.

What is claimed is:

1. An expandable downhole tool assembly for use in a subterranean borehole, the downhole tool assembly comprising:

an expandable tool module comprising:

at least one blade configured as a reamer blade or a stabilizer blade, carried by a tool body and mounted to move between a retracted position and an extended position; and a drive element disposed within the tool body and coupled to the at least one blade, the drive element configured to axially move relative to the tool body to move the at least one blade into the extended position;

an activation module coupled to the expandable tool module and comprising:

an activation member coupled to the drive element and operable to axially move the drive element with respect to the activation module responsive to movement of the activation member; and wherein the expandable tool module is a slave unit configured to not be activated without the activation module.

2. The expandable downhole tool assembly of claim 1, wherein the activation module comprises an electronic and hydraulic activation module configured to receive a signal and respond to the signal by causing hydraulic fluid to move the activation member between an activated position and a deactivated position.

3. The expandable downhole tool assembly of claim 1, wherein the activation module comprises a mechanical activation module configured to be activated without use of an electrical signal.

4. The expandable downhole tool assembly of claim 1, wherein the activation module is configured to move the drive element between an activated position and a deactivated position repeatedly.

5. The expandable downhole tool assembly of claim 1, the expandable reamer module further comprising a yoke coupled to the drive element, wherein the yoke comprises a surface proximate the at least one blade, the surface extending at an angle to the longitudinal axis toward the at least one blade.

6. The expandable downhole tool assembly of claim 1, the expandable tool module further comprising at least one nozzle extending through the tool body in communication with a bore of the body.

7. The expandable downhole tool assembly of claim 6, wherein the drive element comprises a sleeve having at least one hole extending through a sidewall thereof, and wherein the at least one hole is configured to provide continuous drilling fluid flow from the bore through the sleeve and the at least one nozzle.

8. The expandable downhole tool assembly of claim 7, wherein the sleeve is configured to provide a lower rate of drilling fluid flow when the sleeve is in a deactivated position compared to an activated position.

9. The expandable downhole tool assembly of claim 1, further comprising a joint structure joining the drive element of the expandable reamer module to the activation member of the activation module, the joint structure configured to transmit a motive force from the activation module to the drive element.

10. A bottom-hole assembly, comprising:

an expandable tool module comprising a body, at least one blade configured as a reamer blade or a stabilizer blade, and a drive element coupled to the at least one blade, wherein axial movement of the drive element within the body will result in movement of the at least one blade; and an activation module comprising another body coupled to the body and an activation member coupled to the drive element, the activation member configured to pull the drive element into an activated position to move the at least one blade into an expanded position and to push the drive element into a deactivated position to move the at least one blade into a retracted position;

wherein the expandable tool module is a slave unit configured to not be activated without the activation module.

11. The bottom-hole assembly of claim 10, further comprising a pilot bit coupled to the expandable tool module.

12. The bottom-hole assembly of claim 11, wherein the pilot bit is coupled to the expandable tool module by a linking module.

13. The bottom-hole assembly of claim 10, wherein the expandable tool module lacks any mechanism configured to provide motive force to axially move the drive element between the activated position and the deactivated position.

14. The bottom-hole assembly of claim 10, wherein the activation member is configured to pull the drive element into the activated position and to push the drive element into the deactivated position repeatedly.

15. The bottom-hole assembly of claim 10, wherein the activation module comprises an electronic and hydraulic activation module configured to receive a signal and respond to the signal by causing hydraulic fluid to move the activation member between the activated position and the deactivated position.

16. The bottom-hole assembly of claim 10, wherein the activation module comprises a mechanical activation module configured to be activated without use of an electrical signal.

17. A method of using an expandable tool assembly, the method comprising:

coupling a body of an expandable tool module to a body of an activation module wherein the expandable tool module is a slave unit configured to not be activated without the activation module;

disposing the expandable tool module and the activation module in a borehole of a subterranean formation;

pulling, with the activation module, an axially movable drive element at least partially within the body of the expandable tool module to engage at least one blade of the expandable tool module with the subterranean formation; and reaming the borehole with the at least one engaged blade or stabilizing the expandable tool assembly in the borehole with the at least one engaged blade.

18. The method of claim 17, wherein pulling, with the activation module, the axially movable drive element comprises activating the activation module with a first activation apparatus, and further comprising:

removing the expandable tool module and the activation module from the borehole of the subterranean formation;

uncoupling the expandable tool module from the activation module; and coupling the expandable tool module to another, different activation module comprising a second activation apparatus different from the first activation means;

wherein one of the first activation apparatus and the second activation apparatus comprises an electronic and hydraulic activation module and another of the first and second activation means comprises a mechanical activation module.

19. The method of claim 17, wherein coupling the body of the expandable tool module to the body of the activation module further comprises joining the axially movable drive element to a first longitudinal end of a joint structure and an activation member of the activation module to a second longitudinal end of the joint structure.

20. The method of claim 17, further comprising:

pushing, with the activation module, the axially movable drive element to disengage the at least one blade from the subterranean formation; and repeating at least once the pulling, with the activation module, the axially movable drive element to engage the at least one blade with the subterranean formation and the pushing, with the activation module, the axially movable drive element to disengage the at least one blade from the subterranean formation.

* * * * *